US011229299B1

(12) United States Patent
Peterson

(10) Patent No.: US 11,229,299 B1
(45) Date of Patent: Jan. 25, 2022

(54) POCKETED SPRING ASSEMBLY INCLUDING CUSHION PADS AND BUCKLING MEMBERS

(71) Applicant: L&P Property Management Company, South Gate, CA (US)

(72) Inventor: Bruce Peterson, Austin, TX (US)

(73) Assignee: L&P Property Management Company, South Gate, CA (US)

( * ) Notice: Subject to any disclaimer, the term of this patent is extended or adjusted under 35 U.S.C. 154(b) by 388 days.

(21) Appl. No.: 16/399,094

(22) Filed: Apr. 30, 2019

(51) Int. Cl.

| | |
|---|---|
| ***A47C 27/06*** | (2006.01) |
| ***A47C 7/34*** | (2006.01) |
| ***A47C 7/35*** | (2006.01) |
| ***A47C 27/05*** | (2006.01) |
| ***A47C 27/07*** | (2006.01) |

(52) U.S. Cl.
CPC ..... *A47C 27/064* (2013.01); *A47C 7/34* (2013.01); *A47C 7/35* (2013.01); *A47C 27/056* (2013.01); *A47C 27/07* (2013.01)

(58) Field of Classification Search
CPC ..... A47C 27/064; A47C 7/34; A47C 27/056; A47C 27/07; A47C 7/35; A47C 27/00; A47C 27/05; A47C 27/144
USPC ..... 5/720
See application file for complete search history.

(56) References Cited

U.S. PATENT DOCUMENTS 4,234,983 A * 11/1980 Stumpf ..... A47C 27/064 5/246
4,451,946 A * 6/1984 Stumpf ..... A47C 27/064 5/655.8
5,016,305 A * 5/1991 Suenens ..... A47C 27/064 5/655.8
5,987,678 A * 11/1999 Ayers ..... A47C 23/0433 5/720
6,026,527 A 2/2000 Pearce
6,490,744 B1 12/2002 Schulz, Jr.
7,060,213 B2 6/2006 Pearce
8,434,748 B1 5/2013 Pearce et al.
8,628,067 B2 * 1/2014 Pearce ..... A47C 27/16 267/142
8,932,692 B2 1/2015 Pearce
9,661,932 B2 5/2017 Codos
9,949,571 B2 4/2018 Codos
10,098,474 B2 10/2018 Hager et al.
10,188,219 B2 1/2019 Codos
2004/0103479 A1 * 6/2004 Mossbeck ..... A47C 23/0433 5/720

(Continued)

OTHER PUBLICATIONS

Polyurethanes, "What is Polyurethane", 2018, p. 1 (Year: 2018).*

*Primary Examiner* — David R Hare
*Assistant Examiner* — Luke Hall
(74) *Attorney, Agent, or Firm* — Wood Herron & Evans LLP

(57) ABSTRACT

A pocketed spring assembly comprises a plurality of parallel strings of springs, each string joined to at least one adjacent string, each string comprising one piece of fabric folded into first and second opposed plies. Outer pockets are formed along each string by transverse seams joining the first and second plies. One pocketed spring, at least cushion pad and at least one buckling member are positioned in each outer pocket. At least one cushion pad, at least one buckling member or any combination thereof may be individually pocketed inside an outer pocket.

19 Claims, 23 Drawing Sheets

(56) References Cited

U.S. PATENT DOCUMENTS

| | | | | |
|---|---|---|---|---|
| 2008/0093784 | A1* | 4/2008 | Rawls-Meehan | A47C 27/148<br>267/80 |
| 2010/0227091 | A1* | 9/2010 | Pearce | B32B 5/024<br>428/36.1 |
| 2016/0249744 | A1* | 9/2016 | Eigenmann | A47C 27/05<br>5/655.8 |
| 2016/0270545 | A1* | 9/2016 | Codos | A47C 27/05 |
| 2017/0354267 | A1* | 12/2017 | Alletto, Jr. | F16F 3/04 |
| 2019/0150629 | A1* | 5/2019 | Pearce | A47C 27/15 |
| 2021/0003186 | A1* | 1/2021 | Cesko | A47C 7/18 |

* cited by examiner

POCKETED SPRING ASSEMBLY INCLUDING CUSHION PADS AND BUCKLING MEMBERS

FIELD OF THE INVENTION

This invention relates generally to bedding and seating products and, more particularly, to pocketed spring assemblies used in bedding and seating products.

BACKGROUND OF THE INVENTION

Mattress spring core construction over the years has been a continuously improving art with advancements in materials and machine technology. A well-known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

Improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds, instead of stitching, are used to form the pockets encapsulating the springs.

Once strings of pocketed springs are constructed, they may be assembled to form a pocketed spring core or assembly for a mattress, cushion or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of pocketed coil springs serving as a complete spring core assembly.

Conventional pocketed spring cores incorporating pocketed strings of springs have less motion transfer between sleeping partners when compared to traditional helically-laced open coil spring assemblies. Each pocketed coil spring is able to move with greater independence and, therefore provide less influence on adjacent pocketed coil springs than if the coil springs were not inside individual pockets. However, with a traditional pocketed spring mattress, a sheet of foam or other cushioning layer is attached to an upper surface of the pocketed spring assembly. The foam or cushioning sheet or sheets acts like a bridge, such that a load applied to one side of a mattress affects the other side of the mattress, providing an undesirable bridging effect. The present invention eliminates the undesirable bridging effect by encapsulating individual cushion members inside outer pockets of strings of springs.

U.S. Pat. No. 6,490,744 discloses a pocketed spring assembly incorporating strings which have individually pocketed coil springs with cushioning pads inside the pockets. However, due to the individual coil springs being un-pocketed, the coil springs may damage the cushioning pads and/or affect the feel of the pocketed spring assembly due to the coil springs pressing against the cushioning pads. The capability of the individually pocketed springs to act independently from the adjacent pocketed springs in the string of springs may be compromised.

Therefore, there remains a need to combine multiple technologies to improve the feel and motion transfer in a bedding or seating product having a pocketed spring core.

SUMMARY OF THE INVENTION

In one aspect, a bedding or seating product is provided. The product comprises a pocketed spring assembly comprising a plurality of parallel strings of springs, each string joined to at least one adjacent string. Each string comprises a piece of fabric surrounding a plurality of inner pocketed springs, a plurality of cushion pads and a plurality of buckling members, first and second opposed plies of fabric being on opposite sides of the pocketed springs, cushion pads and buckling members. Outer pockets are formed along the length of the string by a longitudinal seam and transverse seams joining the first and second plies. At least one pocketed spring, at least one cushion pad and at least one buckling member are in each of the outer pockets. Each cushion pad may be individually pocketed and may be any desired size or shape. Each buckling member may be individually pocketed and may be any desired size or shape. At least one cushion pad and at least one buckling member may be pocketed together and may be any desired size or shape.

Different coil springs may be located inside the inner pockets. In one embodiment, each of the coil springs has upper and lower end turns and a plurality of central convolutions between the end turns, the convolutions decreasing in diameter and pitch from a middle portion of the spring towards at least one of the end turns. In another embodiment, each of the coil springs has upper and lower end turns and a plurality of central convolutions between the end turns, each of the convolutions being the same diameter. Regardless of the configuration of coil spring, each coil spring is preferably made of one piece of wire of a uniform diameter, but not in all cases.

In some embodiments, an upper end of each transverse seam forming adjacent pockets of the string is below an upper surface of the string of springs to partially separate adjacent outer pockets. In other embodiments, such as double-sided pocketed spring assemblies, each end of each transverse seams has a length less than the height of the of the string to partially separate adjacent outer pockets. In the bedding industry, pocketed spring assemblies having such transverse seams are said to have a "split top" feature. Cushioning materials may be placed on the pocketed spring assembly, and a covering, usually an upholstered covering, encases the pocketed spring assembly and cushioning materials.

The strings may extend longitudinally (from end-to-end) or transversely (from side-to-side). A pocketed spring assembly for use in a bedding or seating product may be posturized into regions or zones of different firmness by incorporating different strings into the pocketed spring assembly.

If the strings extend transversely, the pocketed spring assembly may include a plurality of the strings having the "split top" feature in the transverse seams between adjacent outer pockets and strings lacking the "split top" feature, the strings arranged in a plurality of zones longitudinally spaced apart. For example, the pocketed spring assembly may include three such zones. The three zones may comprise a central zone, a head end zone and a foot end zone. The end zones may comprise strings having the "split top" feature, and the strings comprising central zone may comprise strings lacking the "split top" feature. Alternatively, the end zones may comprise strings lacking the "split top" feature, and the strings comprising central zone may comprise strings with the "split top" feature.

If the strings extend longitudinally, the pocketed spring assembly may include strings having the "split top" feature in the transverse seams between adjacent outer pockets and other strings lacking the "split top" feature, the strings arranged in a plurality of zones transversely spaced apart. For example, the pocketed spring assembly may include two such zones, a "his" side and a "hers" side. The "hers" side or zone may comprise strings of springs having the "split top" feature, and the "his" side or zone can comprise strings of springs lacking the "split top" feature.

In another aspect, a pocketed spring assembly for a bedding or seating product is provided. The pocketed spring assembly comprises a plurality of parallel strings. Each string is joined to at least one adjacent string. Each of the strings comprises a plurality of interconnected outer pockets made from one piece of fabric. Each of the outer pockets contains at least one inner pocketed spring, at least one cushion pad and at least one buckling member. The piece of fabric is joined to itself along a longitudinal seam and has first and second opposed plies of fabric on opposite sides of the inner pocketed springs. The first and second plies of fabric are joined by transverse seams between adjacent inner pocketed springs.

In some embodiments, each of the transverse seams forming the adjacent outer pockets of the string has one end located below an upper surface of the string to partially separate adjacent outer pockets. In other embodiments, each of the transverse seams forming the adjacent outer pockets of the string has one end located below an upper surface of the string and the other end located above a lower surface of the string. Such a string is considered to have the "split top" feature on both sides of the string.

In another aspect, a string of springs for a pocketed spring assembly for a bedding or seating product is provided. The pocketed spring assembly comprises a plurality of parallel strings of springs. Each string is joined to an adjacent string. Each of the strings comprises a plurality of interconnected outer pockets made from one piece of fabric. Each of the outer pockets contains at least one inner pocketed spring, at least one cushion pad and at least one buckling member. The piece of fabric is joined to itself along a longitudinal seam and has first and second opposed plies of fabric on opposite sides of the inner pocketed springs. The fabric of the first and second plies is joined by transverse seams which are shorter than the string. Each of the transverse seams forming the adjacent outer pockets of the string has an upper end located below an upper surface of the string to partially separate adjacent outer pockets and enable some of the buckling members to compress without substantially compressing the buckling members within other outer pockets of the spring.

One advantage of the present invention is that when a bedding or seating product, such as a mattress, is manufactured, the manufacturer need not place one or more sheets of cushioning material over the pocketed spring assembly prior to the unit being upholstered. The mattress manufacturer may simply place a cover around the pocketed spring assembly without using any sheets of cushioning material.

Another advantage of the present invention is that the inner pocketed coil spring does not press into the cushion pad above/below it when subjected to a load. Because the inner pocketed spring is retained in its own inner pocket independent of the cushion pad or pads, the inner pocketed spring does not exert force on the cushion pad or pads, thereby preserving the designed characteristics of the cushion pad or pads such as firmness, for example. The inner pockets of fabric surrounding the coil springs and/or the fabric surrounding each cushion pad preserves the integrity of the cushion pads and increases the life of the pocketed spring assembly. The result is that the user "feels" more of the cushion pad or pads.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
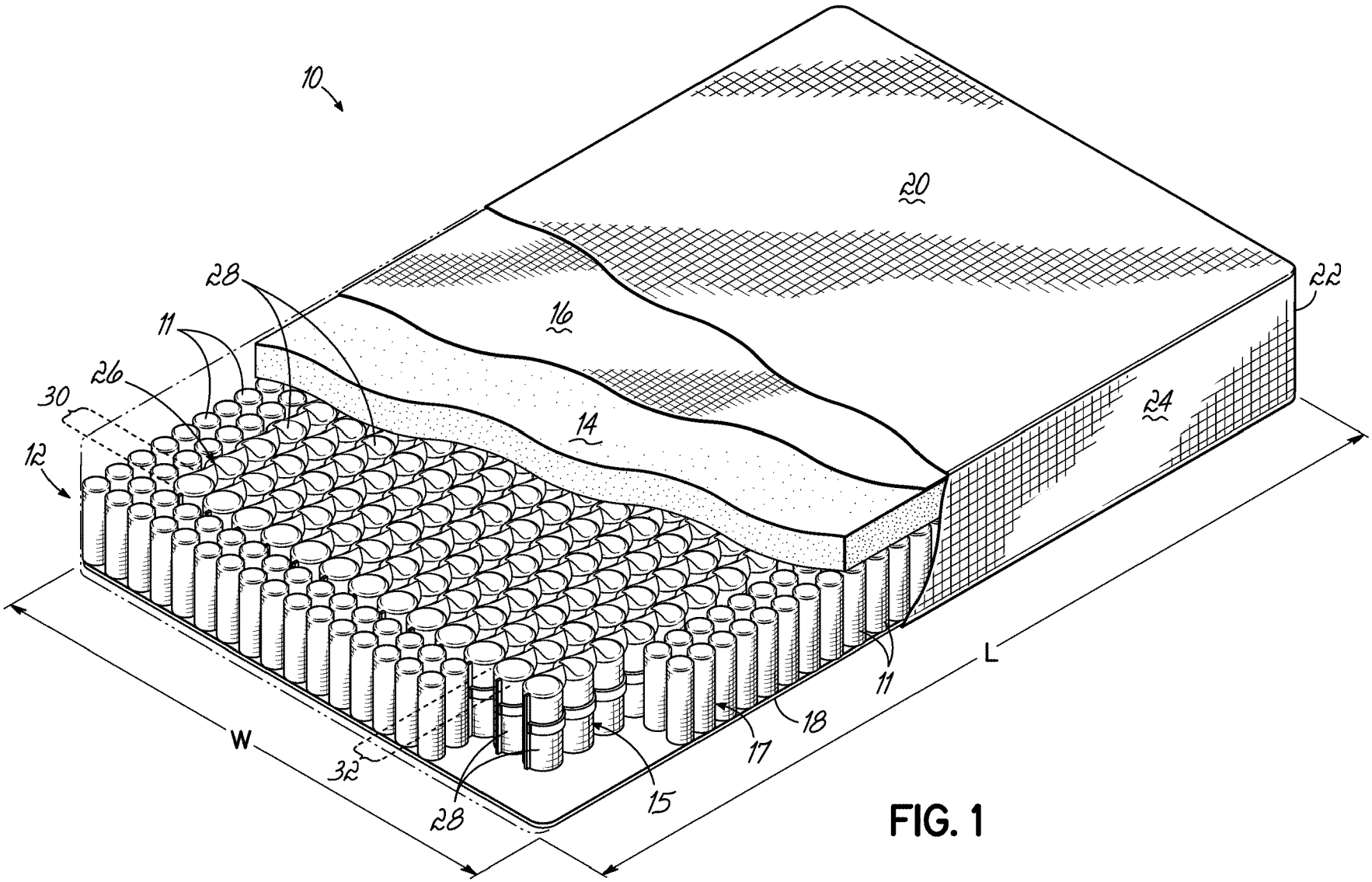
FIG. 1 is a perspective view, partially broken away, of a bedding or seating product incorporating a pocketed spring assembly according to the principles of the present invention.

Referring first to FIG. 1, there is illustrated a bedding product in the form of a single-sided mattress 10 incorporating the principles of the present invention. This product or mattress 10 comprises a pocketed spring assembly 12 over the top of which there lay conventional padding or cushioning layers 14, 16 which may be foam, fiber, gel, a pocketed spring blanket or any other suitable materials or any combination thereof. The pocketed spring assembly 12 includes a central portion 15 and border 17 surrounding the central portion 15. The pocketed coil springs 11 of the border 17 may be of a different diameter than pocketed coil springs 28 of the central portion 15. Although one type of border 17 is illustrated, the border may assume other forms or shapes of any desired size, such as pocketed coil springs of different geometries than the pocketed springs of the central portion. Alternatively, the border 17 may be omitted in this embodiment or any embodiment described or shown herein. This complete assembly is mounted upon a base 18 and is completely enclosed within an upholstered covering material 20.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 1, the central portion 15 of pocketed spring assembly 12 is manufactured from multiple strings 26 of pocketed springs 28 joined together. Each string of pocketed springs 26 extends longitudinally or from head-to-foot along the full length of the product 10.

Figure 1A:
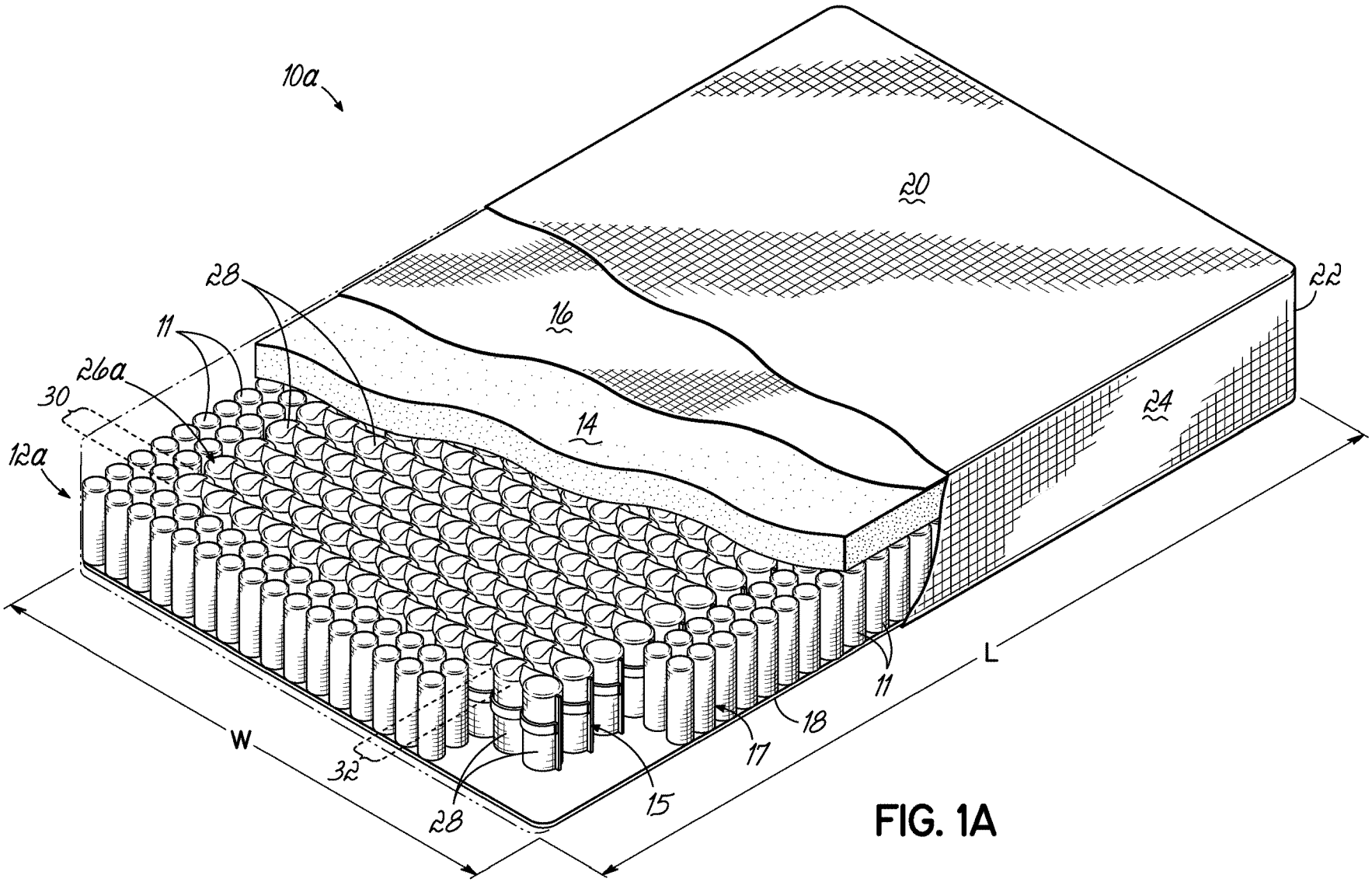
FIG. 1A is a perspective view, partially broken away, of a bedding or seating product incorporating another pocketed spring assembly.

Although the central portion 15 of the strings of pocketed springs 26 are illustrated as extending longitudinally or from head-to-foot in the pocketed spring assembly 12 of FIG. 1, they may extend transversely or from side-to-side as shown in the pocketed spring assembly 12*a* shown in the product 10*a* shown in FIG. 1A. The central portion 15 of pocketed spring assembly 12*a* comprises multiple strings 26*a* of pocketed springs, identical to the strings of springs 26, but shorter in length.

Figure 1B:
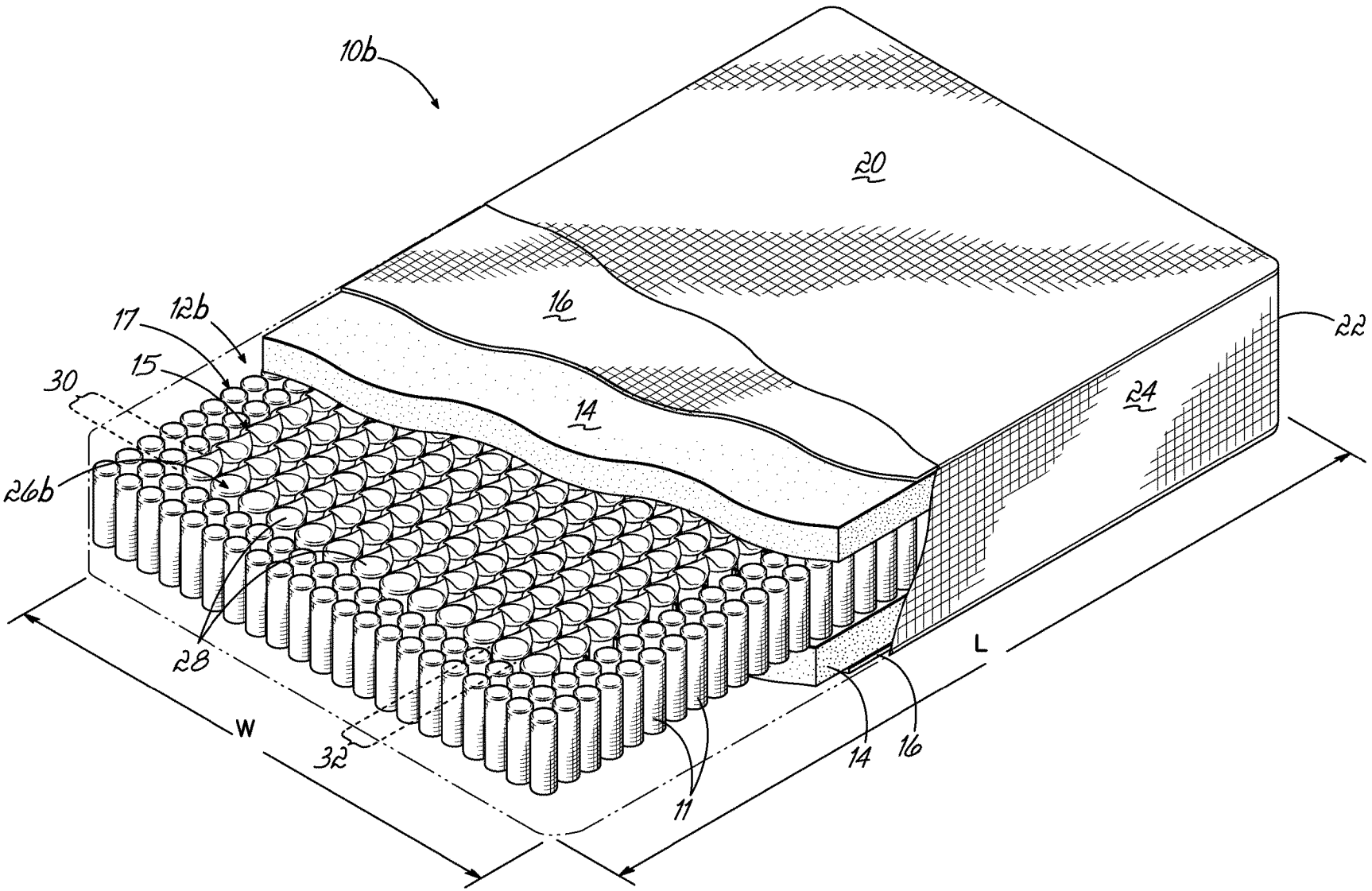
FIG. 1B is a perspective view, partially broken away, of a double-sided bedding product incorporating another pocketed spring assembly.

FIG. 1B illustrates a double-sided mattress 10*b* comprising a pocketed spring assembly 12*b* having a central portion 15 and border 17, as shown in the mattress 10 of FIG. 1. However, the mattress 10*b* of FIG. 1B has conventional padding layers 14, 16 above and below a double-sided pocketed spring assembly 12*b*. The central portion 15 of the double-sided pocketed spring assembly 12*b* comprises a plurality of strings 26*b* of pocketed springs, one being partially shown in cross-section in FIG. 7.

Figure 1C:
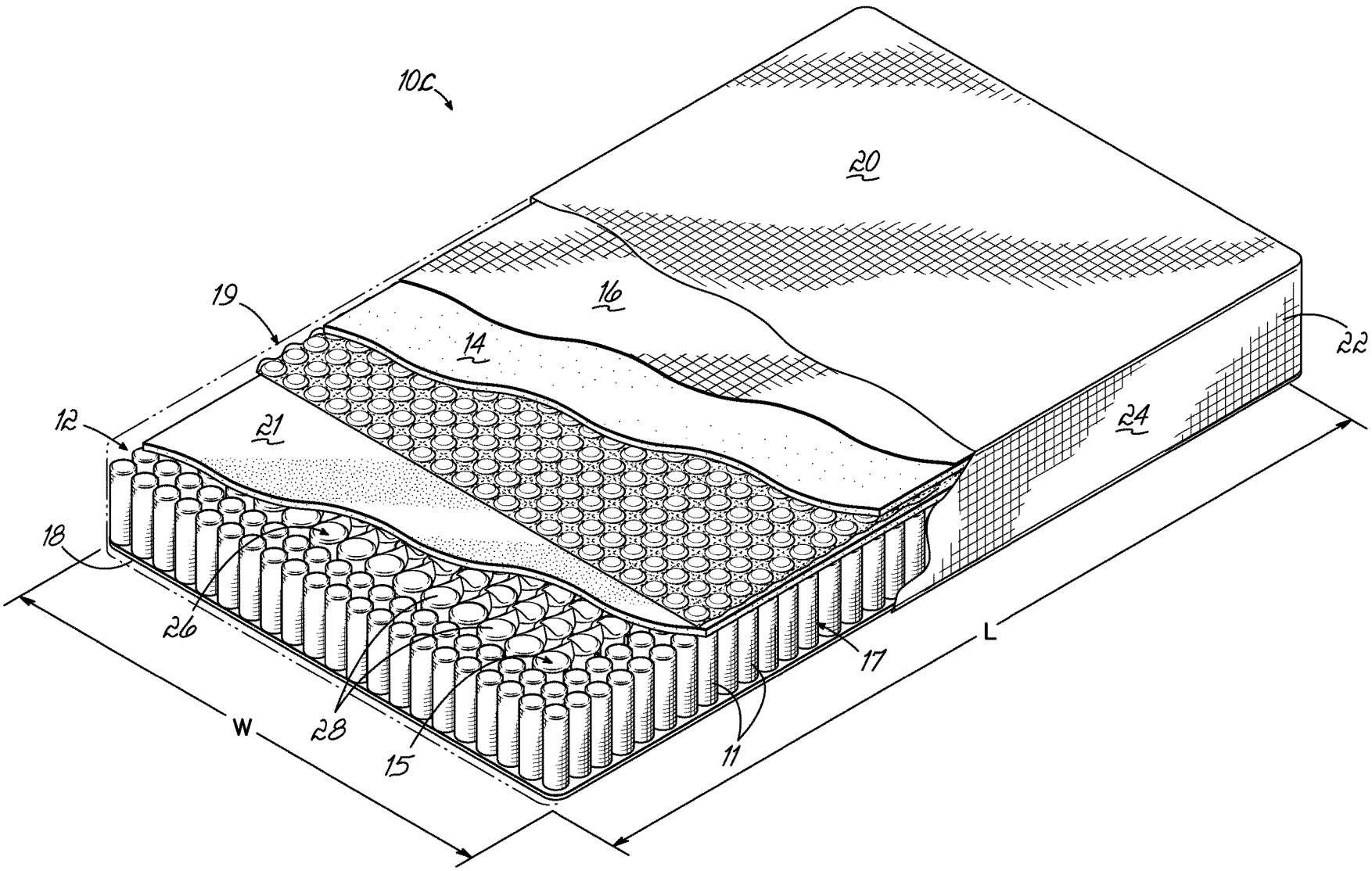
FIG. 1C is a perspective view, partially broken away, of another bedding product incorporating the pocketed spring assembly of FIG. 1.

FIG. 1C illustrates a single-sided mattress 10*c* comprising a pocketed spring assembly 12 having a central portion 15 and border 17, as shown in the mattress 10 of FIG. 1. However, the mattress 10*c* of FIG. 1C has a pocketed topper 19 comprising miniature pocketed coil springs in addition to padding layers 14, 16 above the pocketed topper 19. A scrim layer 21 separates the pocketed topper 19 from the pocketed spring assembly 12. Although one configuration of pocketed topper 19 is illustrated, any pocketed topper or comfort layer known in the art may be used.

According to this invention, any of the padding or cushioning layers, including the pocketed topper 19, may be omitted in any of the embodiments shown or described herein. The novel features reside in the pocketed spring assembly, in at least one of the central portion or border of the pocketed spring assembly.

These strings of pocketed springs 26, 26*a* and 26*b*, and any other strings of springs described or shown herein, may be connected in side-by-side relationship as, for example, by gluing the sides of the strings together in an assembly machine, to create an assembly or matrix of springs having multiple rows and columns of pocketed springs bound together as by gluing, welding or any other conventional assembly process commonly used to create pocketed spring cores or assemblies.

Figure 4:
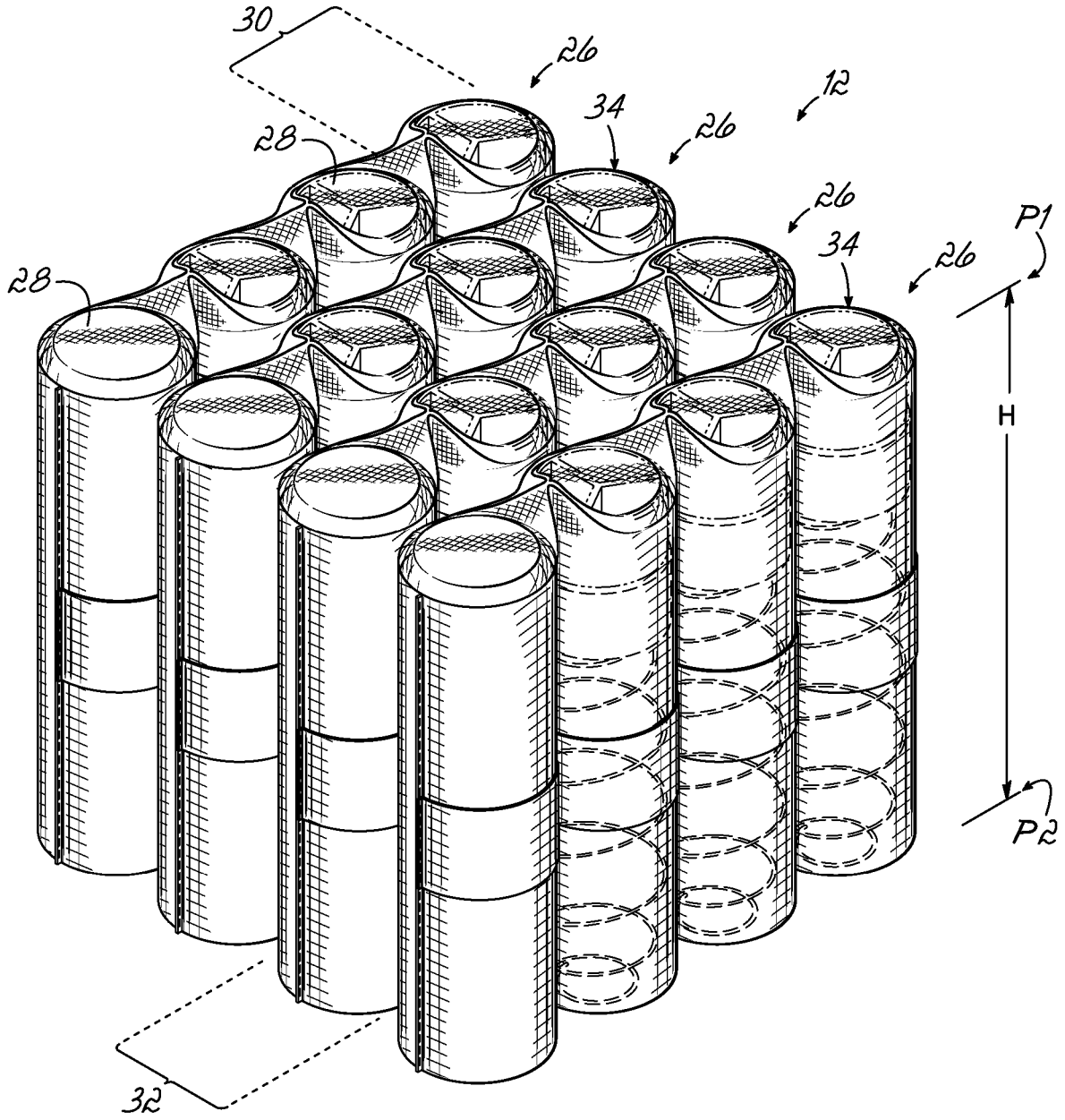
FIG. 4 is a perspective view of a portion of the pocketed spring assembly of FIG. 1 in a relaxed condition.
Figure 5:
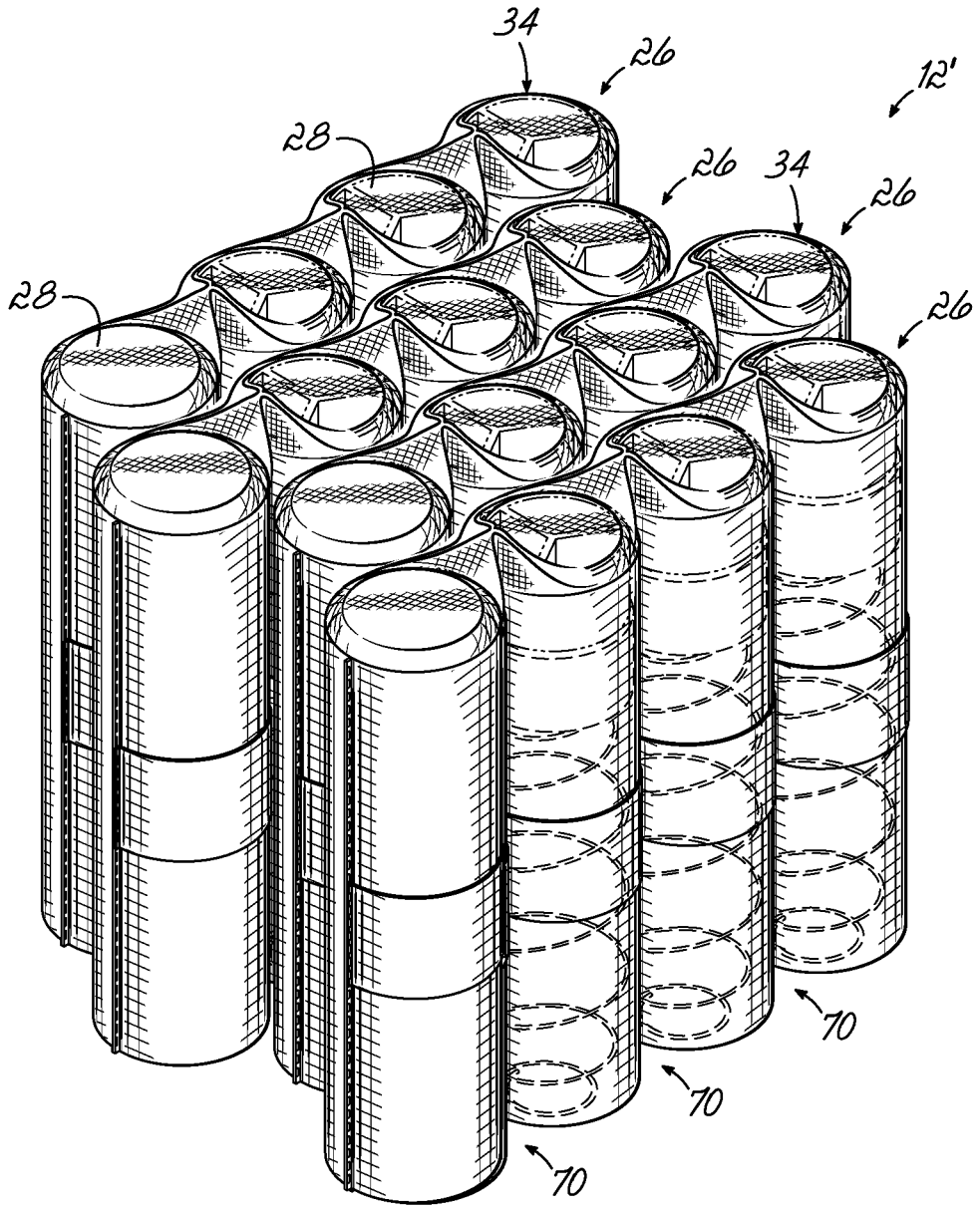
FIG. 5 is a perspective view of a portion of another pocketed spring assembly in a relaxed condition, the strings of springs being offset from one another.

Referring to FIGS. 4 and 5, the strings 26 of pocketed springs may be joined so that the individually pocketed springs 28 are aligned in transversely extending rows 30 and longitudinally extending columns 32. Alternatively, the strings 26 of pocketed springs may be offset from one another in a pocketed spring assembly. In such an arrangement, shown in FIG. 5, the individually pocketed springs 28 are not aligned in rows and columns; instead the individually pocketed springs 28 fill gaps or voids 70 of the adjacent strings 26. FIG. 5 shows a portion of a pocketed spring assembly 12' with multiple strings 26 arranged in this manner. Either alignment of strings may be incorporated into any of the pocketed spring assemblies or cores illustrated or described herein. Although FIGS. 4 and 5 illustrate strings 26, the same alignments may be used in any pocketed spring assembly disclosed herein having any strings disclosed herein including strings 26*a* or 26*b*.

Figure 2:
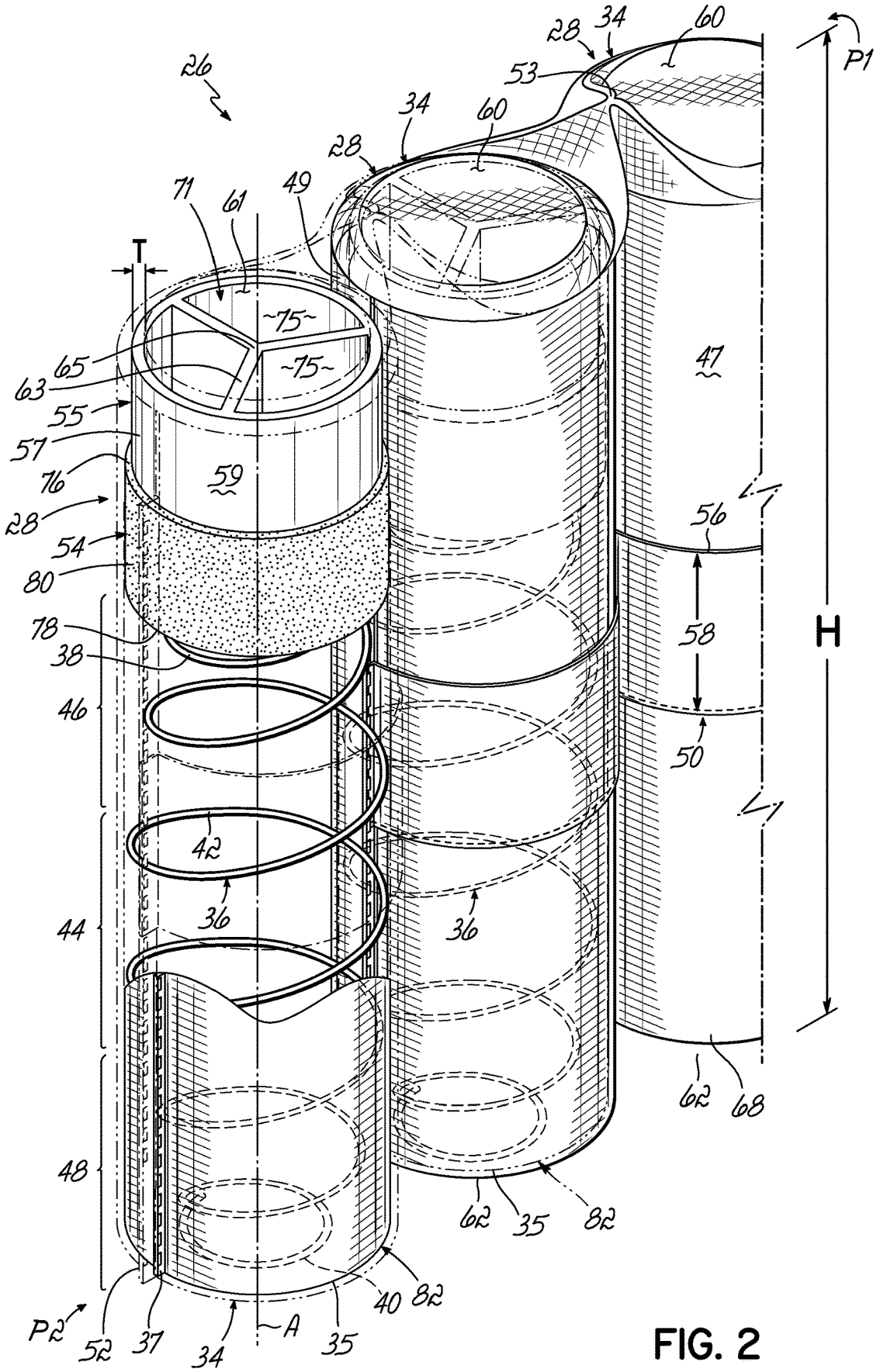
FIG. 2 is a perspective view, partially broken away, of a portion of a string of springs of the pocketed spring assembly of FIG. 1 in an unloaded condition.
Figure 3:
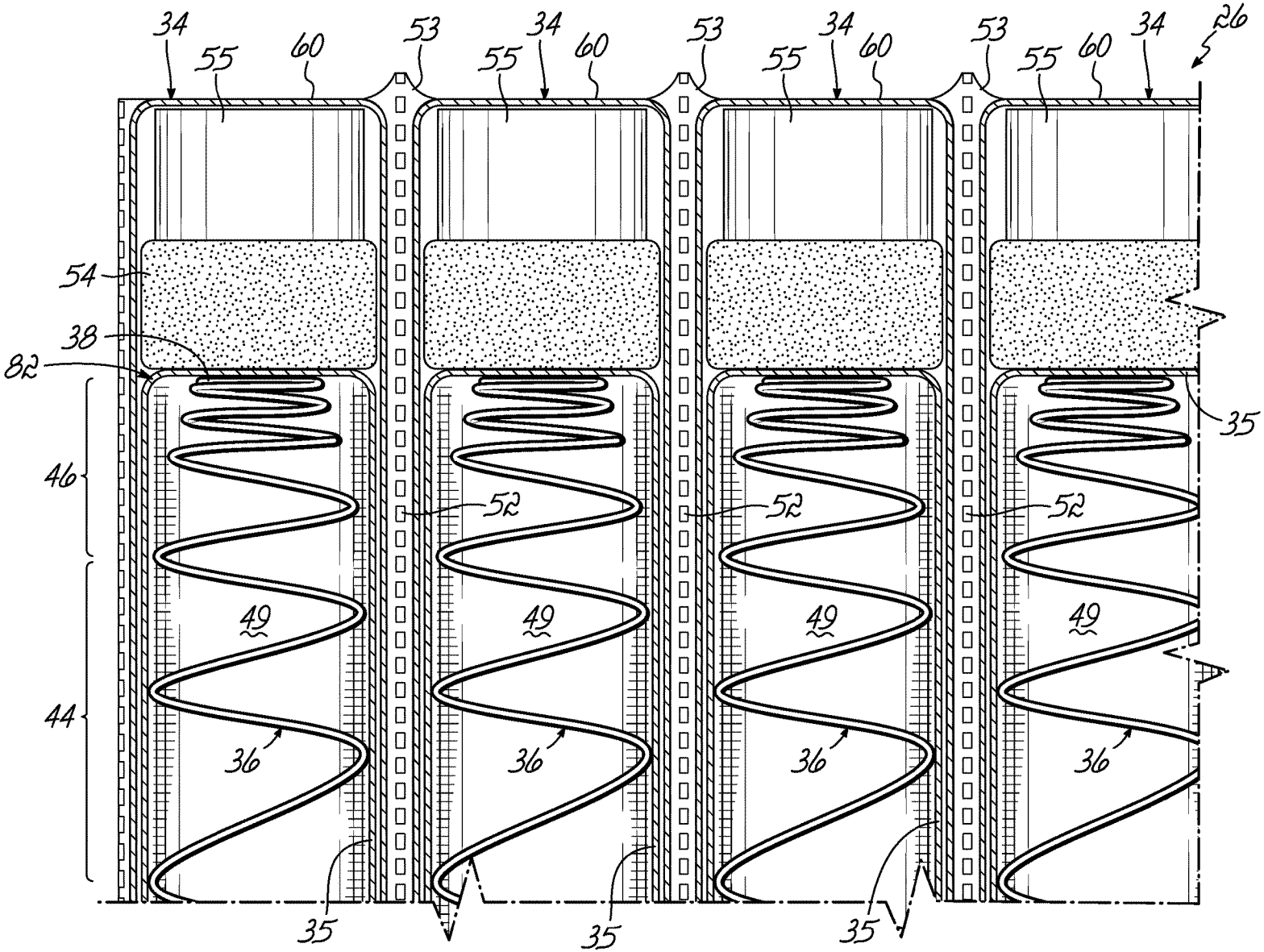
FIG. 3 is a cross-sectional view, partially broken away, of the portion of the string of FIG. 2 in an unloaded condition.
Figure 3A:
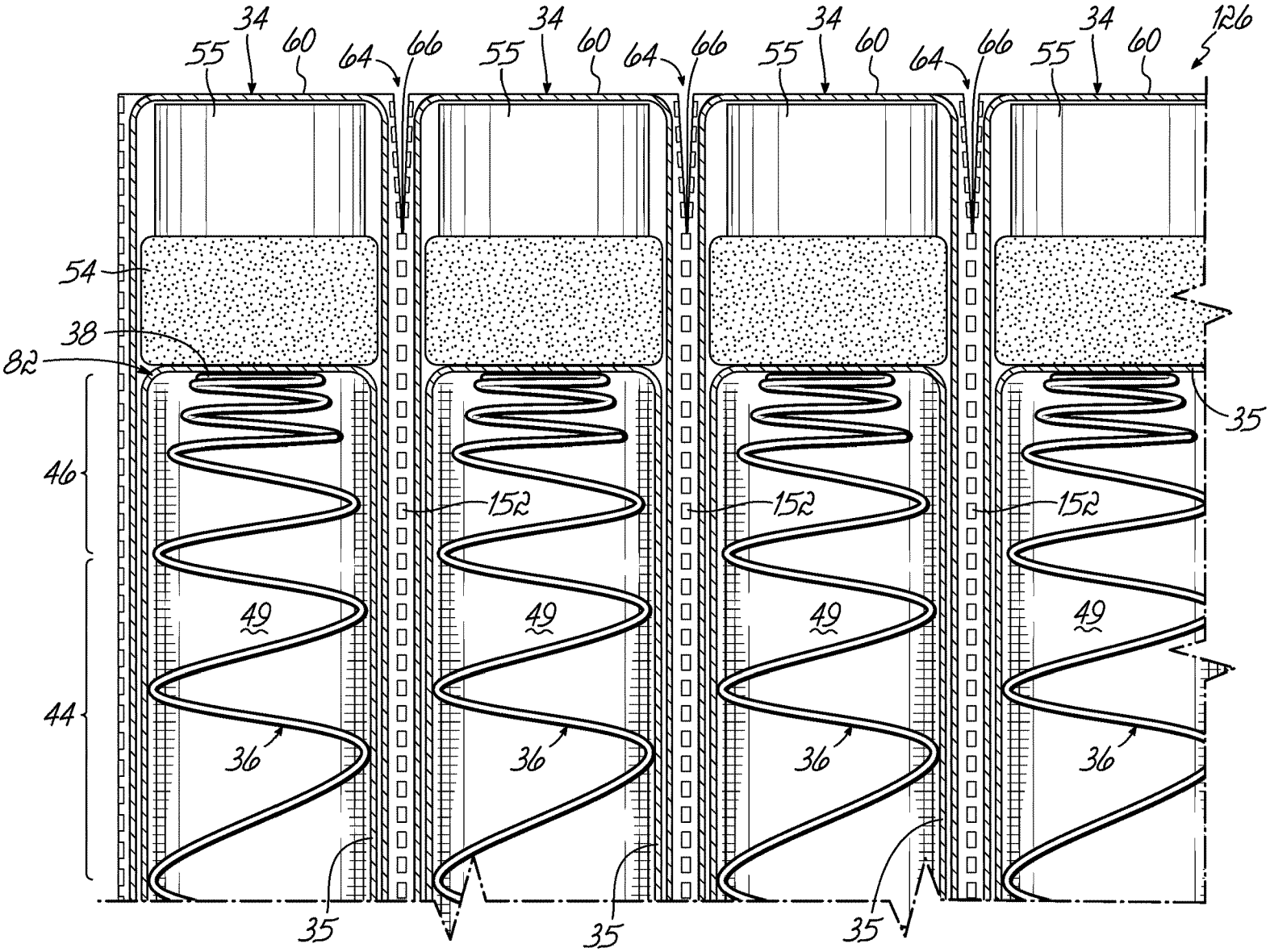
FIG. 3A is a cross-sectional view, partially broken away, of a portion of an alternative string in an unloaded condition.
Figure 3B:
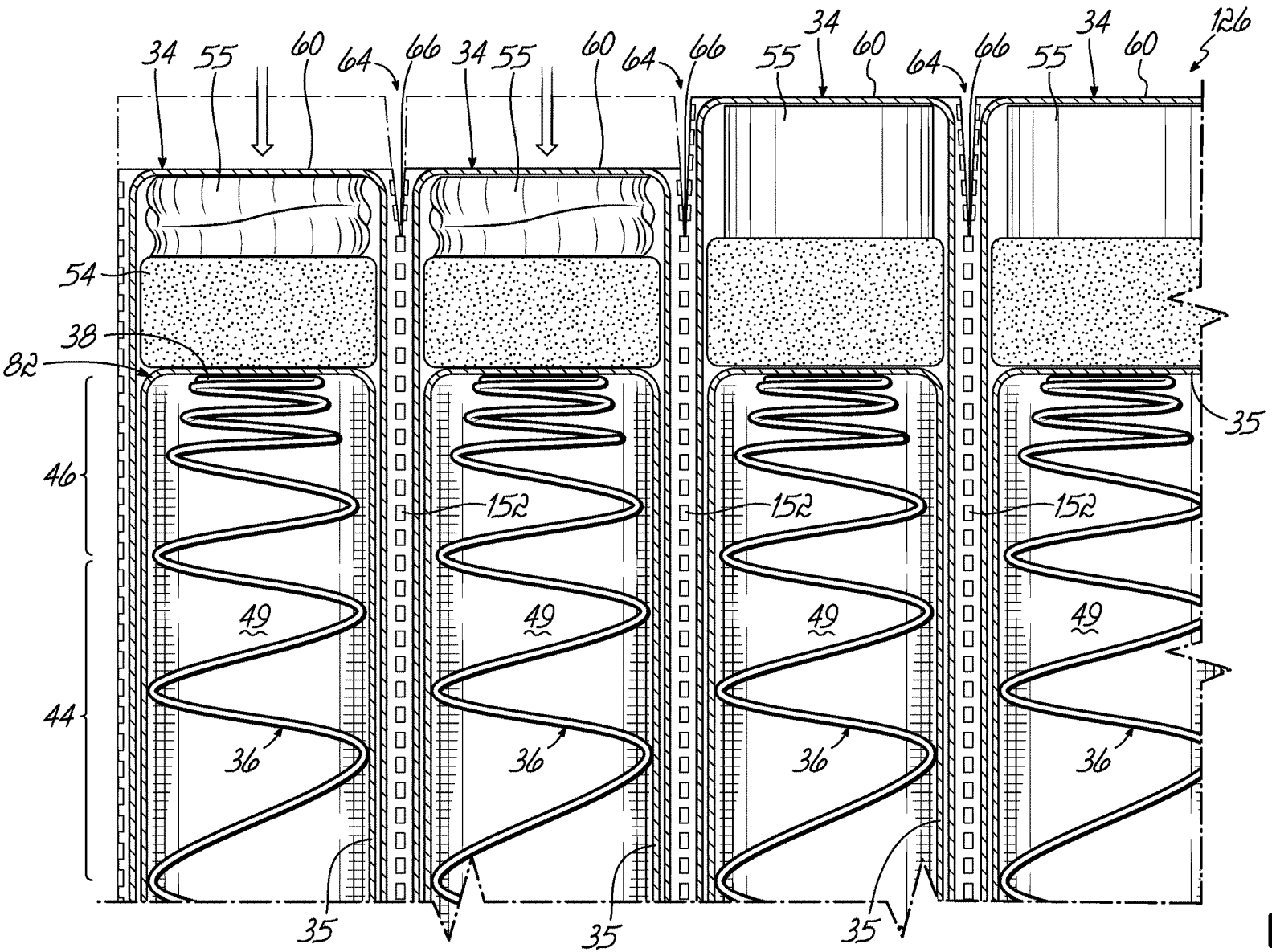
FIG. 3B is a cross-sectional view, partially broken away, of the portion of the string of FIG. 3A showing two pocketed springs being in a loaded condition.

As best illustrated in FIGS. 2, 3A and 3B, each string 26 of pocketed springs 28 comprises a row of interconnected fabric outer pockets 34. Each of the fabric outer pockets 34 contains at least one inner pocketed coil spring 82, at least one cushion pad 54 and at least one buckling member 55. Each inner pocketed coil spring 82 comprises a coil spring 36 encased in an inner pocket 35 having two side seams 37. The inner pocket 35 may be made of a single piece of fabric or any number of pieces of fabric.

FIGS. 2, 3A and 3B illustrate a one-sided string 26 for use in a single-sided pocketed spring assembly, such as pocketed spring assembly 12. In string 26, one cushion pad 54 rests on the fabric of the inner pocket 35 above the individually pocketed coil spring 36. In this orientation, the coil spring 36 is prevented from contacting and damaging the material of the cushion pad 54.

In string 26, one cylindrical shaped buckling member 55 rests on the cushion pad 54 above the cushion pad 54. In the drawings the bucking member 55 is illustrated having approximately the same height as the cushion pad 54. However, the buckling member 55 may have a different height than the cushion pad 54.

For ease of understanding, FIG. 2 illustrates the leftmost outer pocket 34 shown in dashed lines and the inner pocket 35 shown in solid lines. In FIG. 2, the other outer pockets 34 of string 26 are shown in solid lines and the inner pockets 35 shown in dashed lines.

As best shown in FIG. 2, the cushion pad 54 is shown as being shaped like a hockey puck or puck-shaped. Cushion pad 54 is illustrated having a circular upper surface 76, a circular lower surface 78 and a sidewall 80.

Figure 2A:
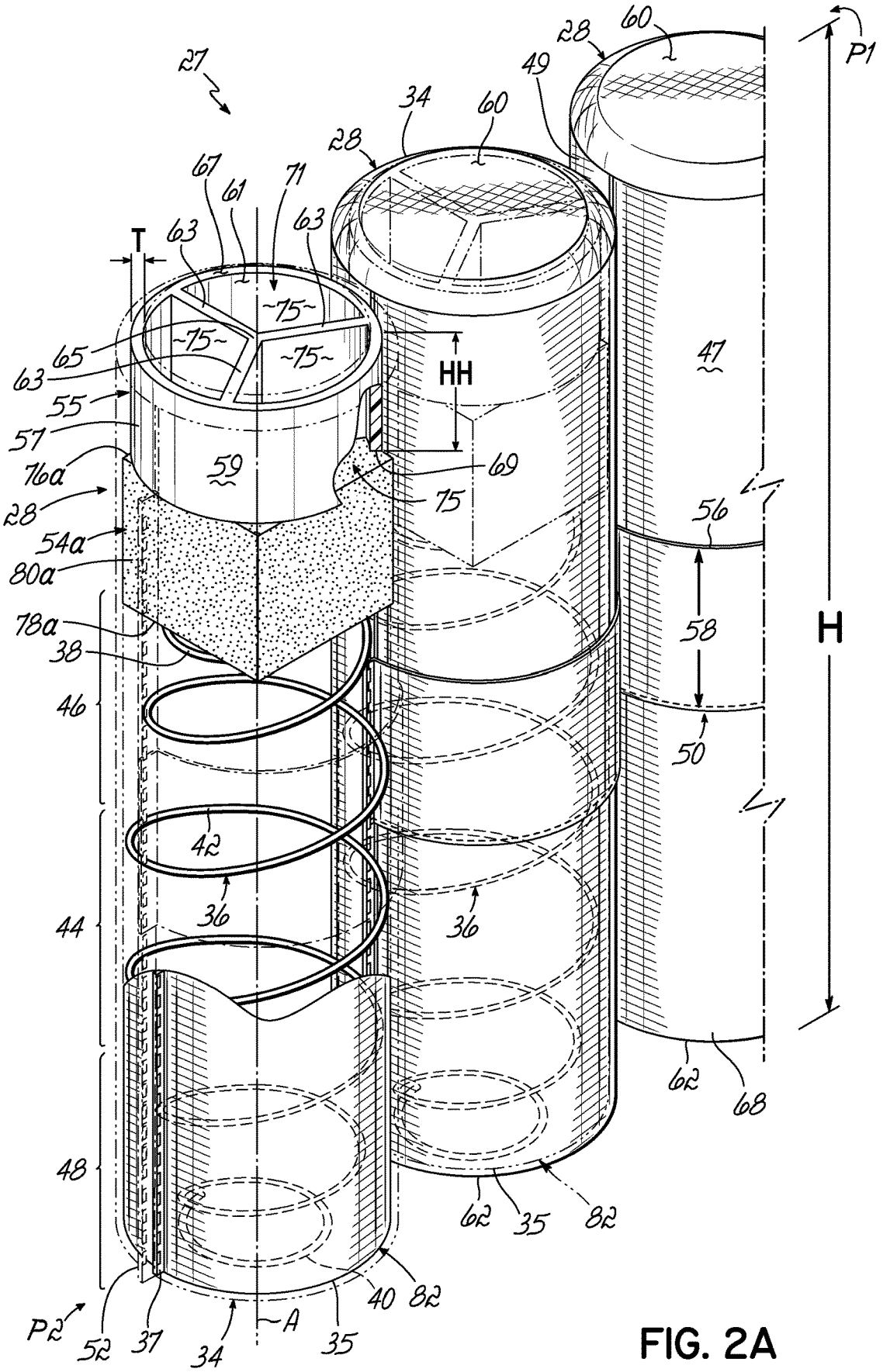
FIG. 2A is a perspective view, partially broken away, of a portion of another string of springs in an unloaded condition.
Figure 2B:
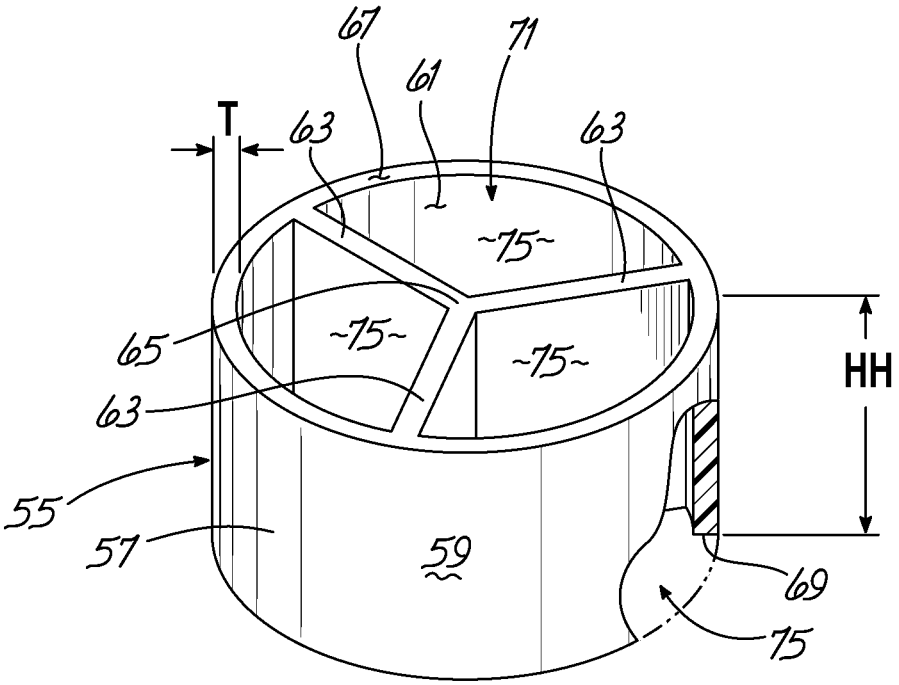
FIG. 2B is a perspective view of a buckling member in a relaxed condition.

As best shown in FIGS. 2, 2A and 2B, the buckling member 55 is shown as being cylindrically shaped like a hockey puck or puck-shaped too. Buckling member 55 is illustrated having an outer wall 57 having an outer surface 59 and an inner surface 61, the distance between which defines the thickness "T" of the outer wall 57. The buckling member 55 has three internal ribs 63 which extend from the outer wall 57 to a center 65. The buckling member 55 has a generally planar upper surface 67 and a generally planar lower surface 69 which define the height "HH" of the buckling member 55. The buckling member 55 has an open top 71 and open bottom 73 defining three passages 75 between the internal ribs 63. Although the drawings illustrate one thickness "T" of outer wall 57, the outer wall may be any desired thickness. Although the drawings illustrate the internal ribs 63 having one thickness, the internal ribs may be any desired thickness.

FIG. 2A illustrates a string 27 identical to string 26 but having a different cushion pad 54*a*. Cushion pad 54*a* has a different shape than cushion pads 54 inside the inner pockets 35 of the string 27. FIG. 2A illustrates a cushion pad 54*a* having a rectangular upper surface 76*a*, a rectangular lower surface 78*a* and four rectangular sidewalls 80*a*. Although FIG. 2A illustrates square upper and lower surfaces and sidewalls, one or more surfaces or sidewalls may be other rectangular shapes. Although FIGS. 2 and 2A illustrate cushion pads 54, 54*a*, respectively, and buckling members 55 of a certain size and shape, the drawings are not intended to limit the size or shape of the cushion pads or buckling members.

Each cushion pad 54, 54*a* is illustrated being a single piece of material, such as foam, but may be any number of pieces of any desired material joined together. Alternatively, the cushion pad 54, 54*a* may be made of fiber, cotton, gel or any combination thereof.

In any embodiment shown or described herein, the buckling member can be made of silicone, a gel elastomer, polyurethane elastomer, polyurea elastomer, polyester, polystyrene, polyethylene, polypropylene and blends thereof. Any other suitable material which buckles when a large enough load is applied thereto may be used such as rubber, latex or other plastic material. Any of the elastomers may be fiber reinforced. Regardless of the material used to make the buckling member, additives such as slow-release fragrances, antimicrobial additives such as copper and silver, color additives, thermochromic materials, bed bug inhibitors, conductive additives such as graphite, aluminum powder, silicon carbide and diamond dust may be incorporated into the material. Density reducing agents such as fumed silica or gas generating materials may be added too.

The coil spring 36 is preferably made of one piece of wire of a uniform diameter, but may be made of other materials, multiple strands of twisted wire and/or may be a non-uniform diameter. As best shown in FIG. 2, each coil spring 36 has a central or longitudinal axis A, an upper end turn 38, a lower end turn 40 and a plurality of central convolutions 42 between the end turns. FIGS. 2 and 3A illustrate a barrel-shaped coil spring 36 in which the diameter of the end turns 38, 40 is less than the diameter of the central convolutions 42, the central convolutions 42 tapering or decreasing in diameter and pitch as one moves from a center or middle portion 44 of the coil spring towards the end turns. As best shown in FIG. 2, each barrel-shaped coil spring 36 has two end portions which are not identical, an upper end portion 46 and a lower end portion 48.

Preferably, one piece of fabric is used to create the outer pockets 34 of the string 26 of pocketed springs 36, the piece of fabric being folded over onto itself around the inner pocketed coil springs 82 and the cushion pads 54. As best shown in FIG. 2, opposite sides or plies 47, 49 of the fabric are sewn, welded or otherwise secured together to create a longitudinal seam 50 and a plurality of separating or transverse seams 52. FIG. 2 illustrates ply 47 being closest to the reader and ply 49 being behind the springs 36.

Although the seams or welds in the embodiments shown herein are shown as being welded spaced rectangles, any of the seams may be spaced dots, triangles or solid line segments without spaces.

As best shown in FIG. 2, opposed edges 56 of the piece of fabric used to create the string 26 of pocketed springs are aligned and spaced from the longitudinal seam 50 a distance indicated by numeral 58. Although the drawings indicated the longitudinal seam 50 being below the free edges 56 of the piece of fabric, the longitudinal seam 50 may be above the free edges 56 of the piece of fabric.

As shown in FIGS. 2 and 3, the piece of fabric used to create the string 26 has a plurality of upper ears 53 and a plurality of lower ears 83. When the ears are collapsed, the string 26 has a generally planar top surface 60 in a top plane P1 and a parallel generally planar bottom surface 62 in a bottom plane P2. The linear distance between the top and bottom surfaces 60, 62 of the string 26 defines a height "H" of the string 26. This linear distance further defines the height H of the pocketed spring assembly 12 because each of the strings 26 has the same height. However, it is within the scope of the present invention that different strings of springs of a pocketed spring assembly have different heights.

As shown in FIGS. 2 and 3, in one embodiment, the transverse seams 52 of string 26 separating adjacent pockets extend from the top of an upper ear 53 of fabric to the bottom of a lower ear 83 of fabric. In an alternative embodiment shown in FIGS. 3A and 3B, the transverse seams 152 of string 126 separating adjacent pockets extend short of the upper and lower ears 53, 83 of fabric, respectively. In the alternative embodiment shown in FIGS. 3A and 3B, each transverse seam 152 is shorter than the height of the string 126 due to divides 64 described herein.

In accordance with the alternative embodiment shown in FIGS. 3A and 3B, in strings 126, the transverse seams 152 separating adjacent outer pockets 34 are divided with divides 64 which may be in the form cuts, slits, or notches created by, for example, cutting, slitting, severing, melting, or the like, from the upper surface 60 of the string 126 inwardly (downwardly as illustrated), to partially separate the adjacent outer pockets 34. Preferably, the divide 64 extends to beyond or below the buckling member 55 but may be any desired length including less than the height of the buckling member 55. As best shown in FIGS. 3A and 3B, the transverse seams 152 of the strings 126 each have an upper end 66 located at the bottom of each divide 64 and a lower end (not shown). As shown in FIG. 3A, the upper end 66 of each transverse seam 152 is located below adjacent buckling member 55 when the inner pocketed coil springs 36 are in a relaxed condition and not loaded. Like the string 26*b* shown in FIG. 7, in a double-sided pocketed spring assembly, the lower end of each transverse seam 152 of the strings 126 may have a divide 64 extending upwardly from a lower surface 62 of the string 126.

The significance of divide 64 may be appreciated with reference to FIG. 3B. Divide 64 essentially decouples each buckling member 55 from its adjacent buckling member 55 during initial deflection of buckling member 55. This creates more of an individual coil performance and allows the inner pocketed coil spring 82 to engage a person sleeping on the mattress 10 sooner while giving the person a softer feel at the beginning of the coil deflections. It is believed that this arrangement provides a more comfortable pocketed spring assembly 12.

Figure 6:
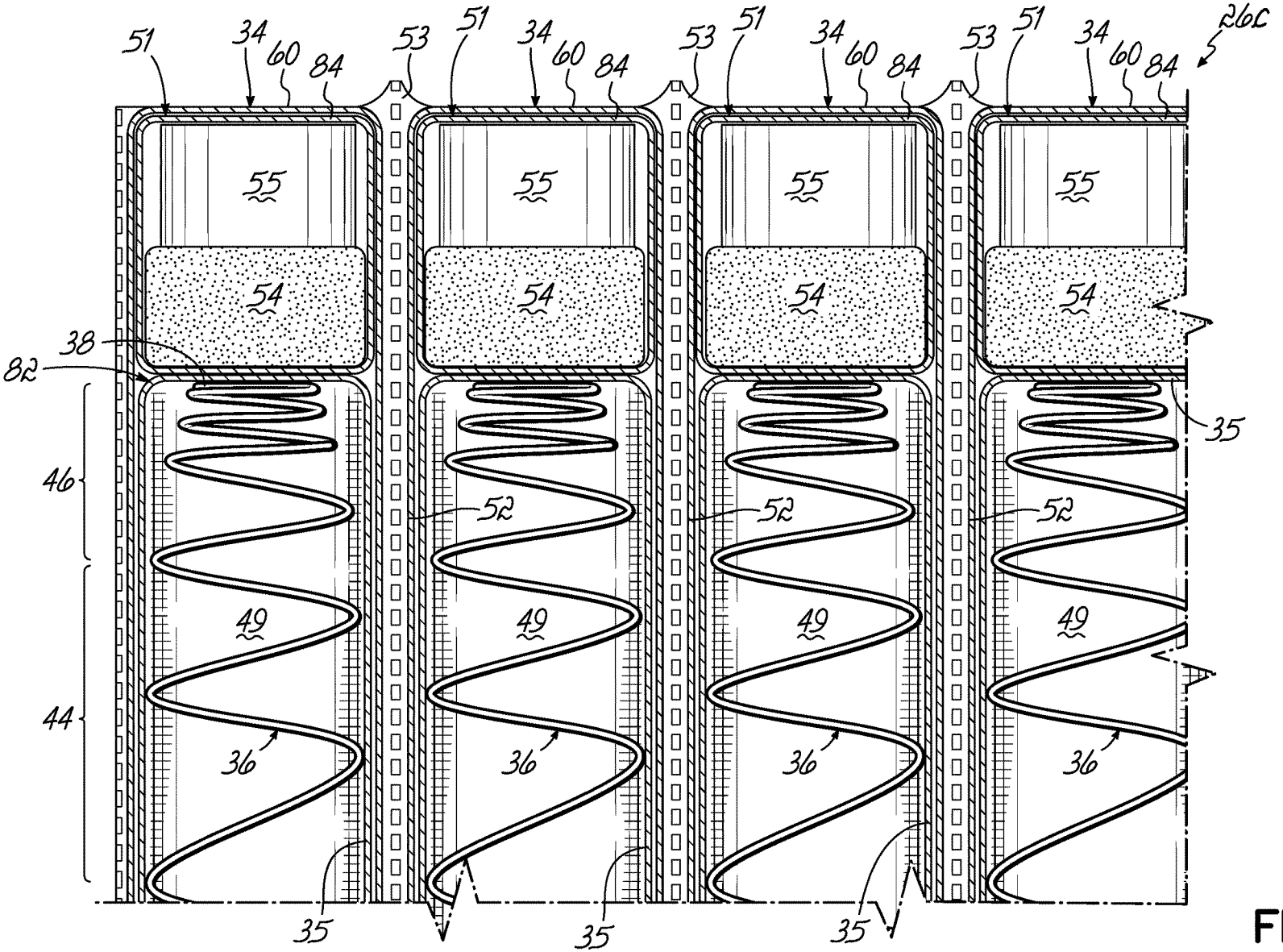
FIG. 6 is a cross-sectional view, partially broken away, of another string of springs in an unloaded condition.

FIG. 6 illustrates another embodiment of string 26*c* which may be used in any of the pocketed spring assemblies or products shown or described herein. The string 26*c* comprises the same seams, same inner pocketed springs 82 and outer fabric pockets 34 as incorporated into strings 26. However, each of the outer fabric pockets 34 includes a combination pad 51 above the inner pocketed coil spring 82. The combination pad 51 comprises a cushion pad 54 and a buckling member 55 which in combination are encased in a fabric cover 84. Each combination pad 51 has its own fabric cover 84 which prevents the coil spring 36 of the inner pocketed coil spring 82 from contacting and damaging the cushion pad or pads over time, in addition to the inner pocket 35 of fabric of the inner pocketed coil spring 82. Although FIG. 6 illustrates each combination pad 51 comprising one cushion pad 54 and one buckling member 55 encased in a fabric cover 84, a combination pad may include more than one cushion pad and/or more than one buckling member. It is also within the scope of the invention that the combination pad 51 comprises one buckling member 55 and one cushion pad 54 encased in a fabric cover 84, the buckling member 55 being closer to the inner pocketed coil spring 82.

Figure 6A:
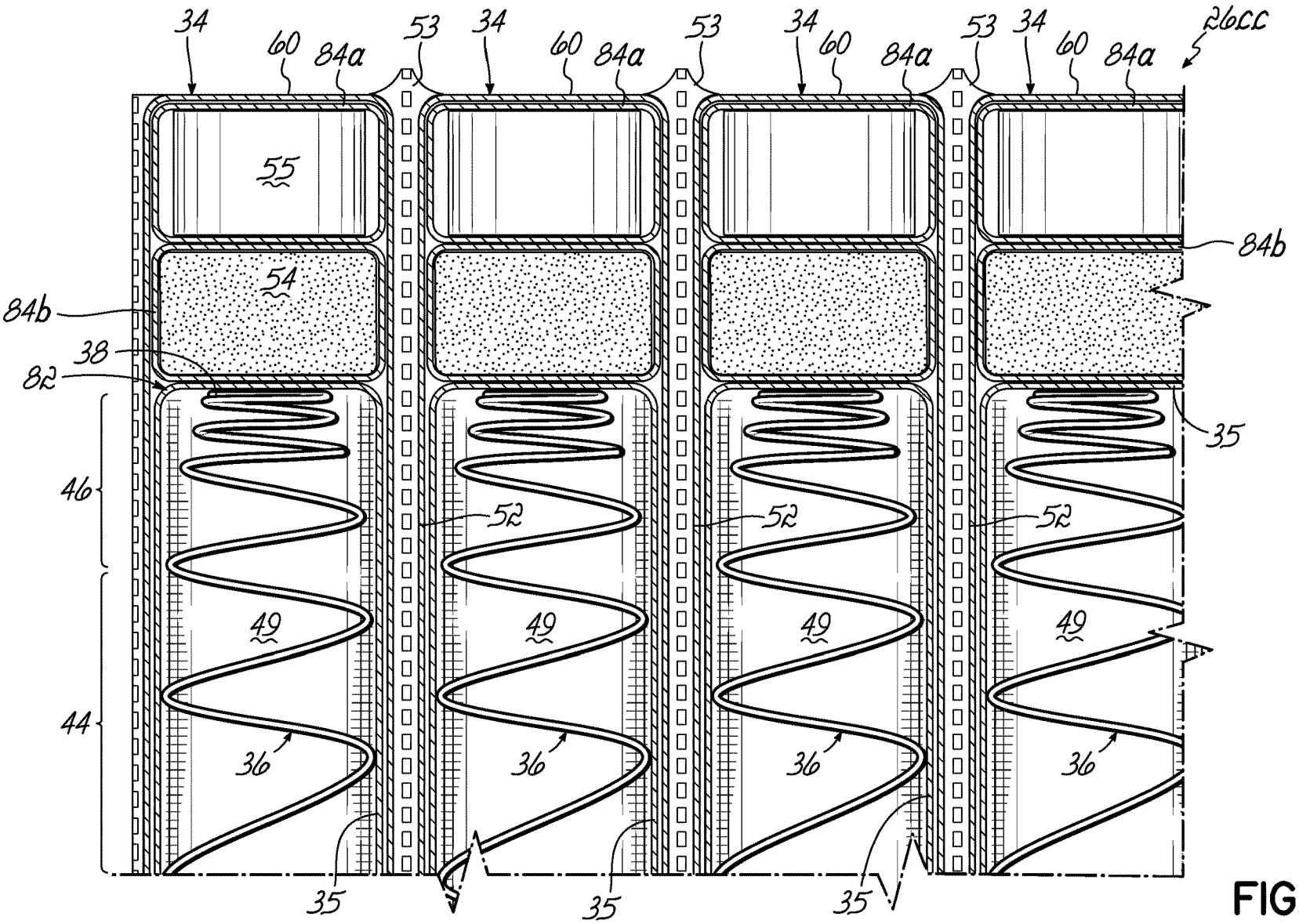
FIG. 6A is a cross-sectional view, partially broken away, of another string of springs in an unloaded condition.

FIG. 6A illustrates another embodiment of string 26*cc* which may be used in any of the pocketed spring assemblies or products shown or described herein. The string 26*cc* comprises the same seams, same inner pocketed springs 82 and outer fabric pockets 34 as incorporated into strings 26. However, each cushion pad 54 is encased in a fabric cover 84*b* and each buckling member 55 is encased in a fabric cover 84*a*. Thus, each cushion pad 54 has its own fabric cover 84*b* which prevents the coil spring 36 of the inner pocketed coil spring 82 from contacting and damaging the cushion pad or pads over time, in addition to the inner pocket 35 of fabric of the inner pocketed coil spring 82.

Figure 7:
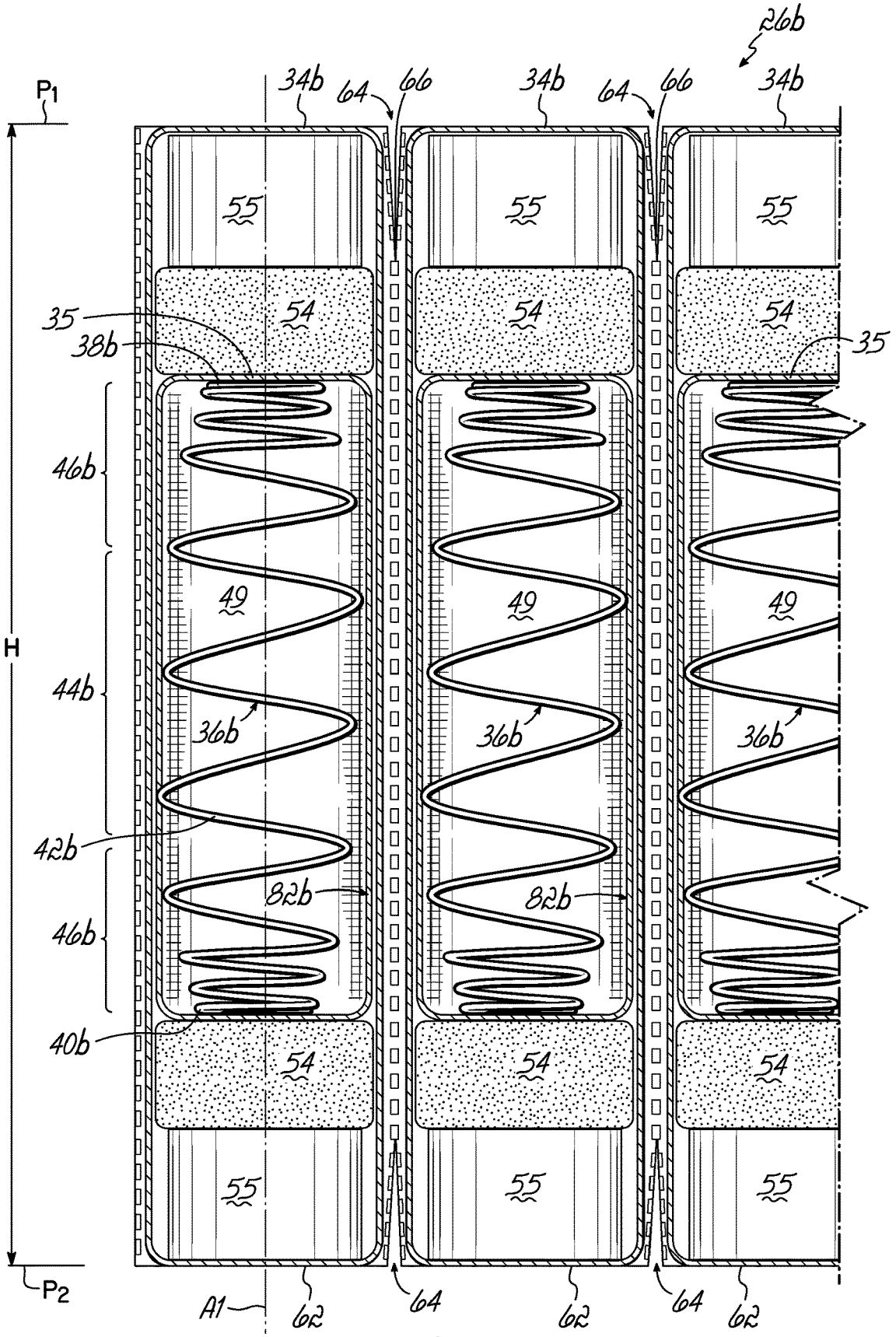
FIG. 7 is a cross-sectional view, partially broken away, of double-sided string of springs in an unloaded condition.

FIG. 7 illustrates another embodiment of string 26*b* which may be used in any of the double-sided pocketed spring assemblies such as double-sided pocketed spring assembly 12*b* used in double-sided mattress 10*b* shown in FIG. 1B. Although string 26*b* shown in FIG. 7 is shown having the split top feature like the strings 126 shown in FIG. 3A, any strings shown or disclosed herein may lack the split top feature regarding of whether single-sided or double-sided. Any of the strings shown herein may be incorporated into any bedding or seating product, including any double-sided mattress or seating cushion. For example, while the mattresses 10, 10*a* and 10*c* illustrated in FIGS. 1, 1A and 10, respectively, are single-sided mattresses having single-sided pocketed spring assemblies 12, 12*a* and 12*c*, respectively, incorporating single-sided strings, any of the strings shown or described herein as being single-sided, may be double-sided for use in a double-sided mattress or seating cushion. Likewise, any of the strings shown or described herein as being double-sided, may be single-sided for use in a single-sided mattress or seating cushion.

FIG. 7 illustrates a portion of a string of springs 26*b* used in a double-sided pocketed spring assembly, like pocketed spring assembly 12*b* shown in FIG. 1B. The fabric outer pockets 34*b* of such strings 26*b* are slightly different than the fabric outer pockets 34 of string of springs 26. There are divides 64 along the tops and bottoms of the strings 26*b*.

FIG. 7 illustrates a two-sided string 26*b* for use in a double-sided pocketed spring assembly 12*b*, as shown in FIG. 1B. Two cushion pads 54 are located inside each outer pocket 34*b* along with an inner pocketed spring 82*b* located between the cushion pads 54. One of the cushion pads 54 is located above the inner pocketed coil spring 82*b* and the other cushion pad 54 is located below the inner pocketed coil spring 82*b*. Although FIG. 7 illustrates cushion pads 54 lacking covers, encased cushion pads 51 or cushion pads of different shapes, such as shown in FIG. 2A, may be used in the double-sided string 26*b* or any string shown or described herein.

Two bucking members 55 are located inside each outer pocket 34*b* along with two cushion pads 54 and an inner pocketed spring 82*b* located between the cushion pads 54 and between the buckling members 55. One of the bucking members 55 is located above one of the cushion pads 54 and above the inner pocketed coil spring 82*b*. The other bucking member 55 is located below the other cushion pad 54 and the inner pocketed coil spring 82*b*. Although FIG. 7 illustrates buckling members 55 lacking covers, encased buckling members or buckling members of different shapes, such as shown in FIG. 12A-12H, or any combination thereof, may be used in the double-sided string 26*b* or any string shown or described herein.

As shown in FIG. 7, the coil springs 36*b* of inner pocketed springs 82*b* are different than the coil springs 36 of inner pocketed springs 82 shown in FIGS. 2 and 3. Each coil spring 36*b* comprises a central or longitudinal axis A1, an upper end turn 38*b*, a lower end turn 40*b* and a plurality of central convolutions 42*b* between the end turns. FIGS. 1B and 7 illustrate a barrel-shaped coil spring 36*b* in which the diameter of the end turns 38*b*, 40*b* is less than the diameter of the central convolutions 42*b*, the central convolutions 42*b* tapering or decreasing in diameter and pitch as one moves from a center or middle portion 44*b* of the coil spring towards the end turns. As best shown in FIG. 7, each barrel-shaped coil spring 36*b* has two identical end portions 46*b*.

Figure 8:
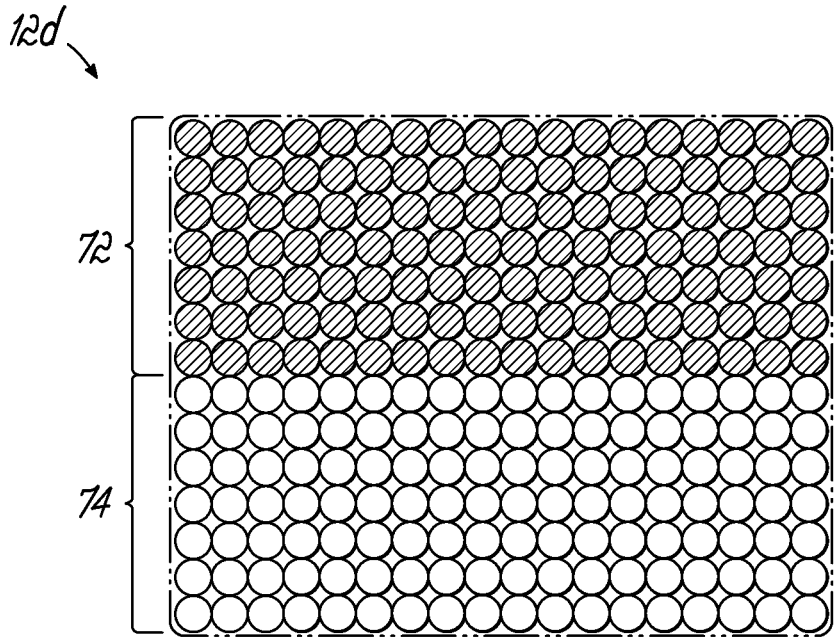
FIG. 8 is a top view of a posturized pocketed spring assembly.

Referring now to FIG. 8, longitudinally extending strings are shown in one preferable arrangement for a pocketed spring assembly for a bedding or seating product, such as a mattress. As can be seen, the longitudinally extending strings are arranged in a plurality of zones on the pocketed spring assembly 12*d*. By way of example, two zones 72, 74 are illustrated, with the zones corresponding roughly to a "firm" side and a "soft" side. By way of further example, the longitudinally extending strings of the "soft" zone 72 may have the split top feature shown and described herein. The longitudinally extending strings of the "firm" zone 74 may lack the split top feature. In another example, the strings of the "soft" zone 72 may have different buckling members or different cushion pads or both than the strings of the "firm" zone 74, resulting in the different zones 72, 74 having different feels or firmness. Of course, other arrangements are within the scope of the invention. For example, a pocketed spring assembly like pocketed spring assembly 12*d* shown in FIG. 8 may comprise transversely extending strings rather than longitudinally extending strings. In such an arrangement, each transversely extending string would have to be half firm and half soft. In one example, each string would have only half the string having the split top feature, the other half lacking such feature.

Figure 9:
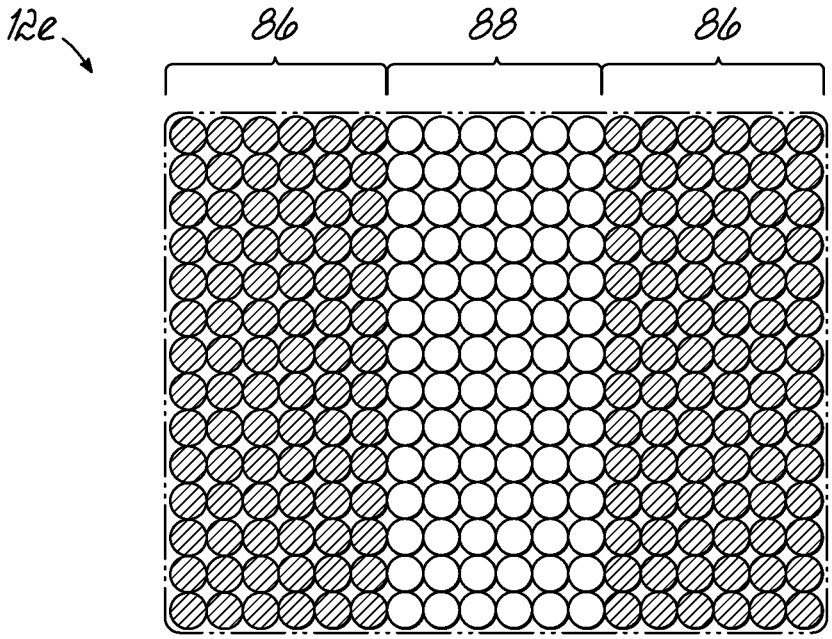
FIG. 9 is a top view of another posturized pocketed spring assembly.

Referring now to FIG. 9, the transversely extending strings are shown in one preferable arrangement for a pocketed spring assembly 12*e* for a bedding or seating product, such as a mattress. As can be seen, the transversely extending strings are arranged in a plurality of zones on the pocketed spring assembly 12*e*. By way of example, three zones are illustrated, with the zones corresponding roughly to the location of a sleeper's head and shoulders, mid-section, knees and feet. By way of further example, the two end "soft" zones 86 each comprise strings of springs having the split top feature shown and described herein. The transversely extending strings of the middle or "firm" zone 88 are strings lacking any split top feature. Of course, other arrangements are within the scope of the invention. For example, the mattress shown in FIG. 9 may comprise longitudinally extending strings rather than transversely extending strings. In such an arrangement, each longitudinally extending string would have to be divided into three sections; a middle "firm" section and two end or "soft" sections. Therefore, each string would have only the end thirds of the string having the split top feature, the middle third lacking such feature.

Figure 3C:
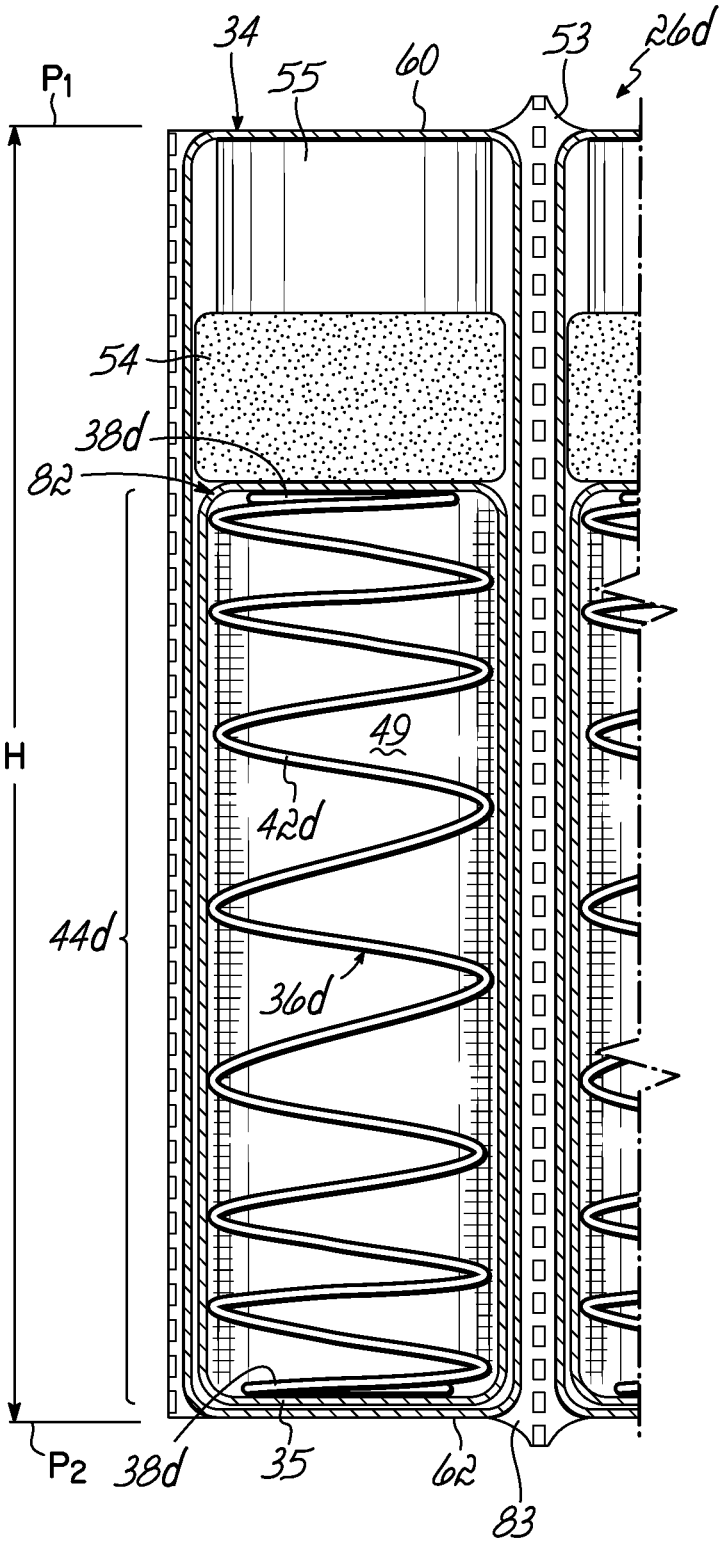
FIG. 3C is a cross-sectional view, partially broken away, of a string of springs having a different spring in an unloaded condition.
Figure 3D:
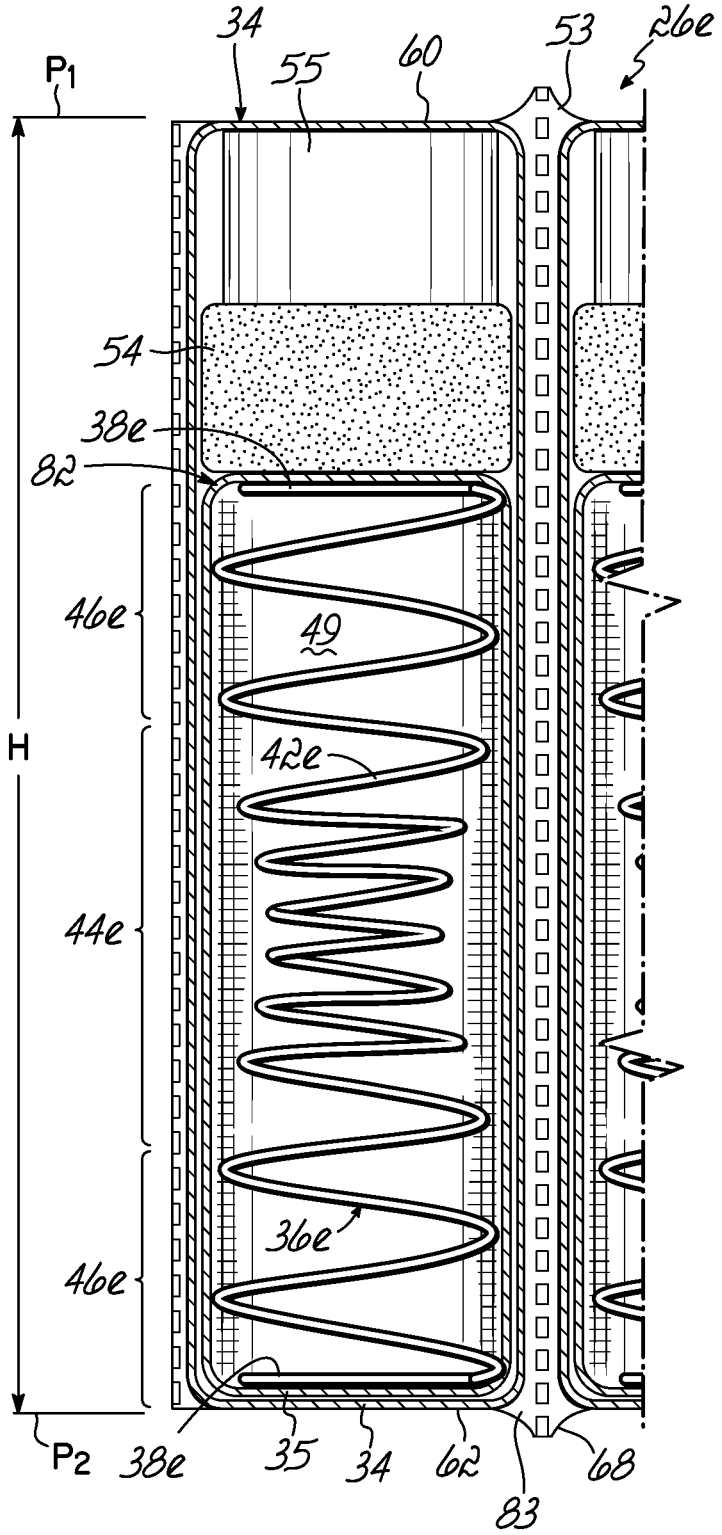
FIG. 3D is a cross-sectional view, partially broken away, of a string of springs having a different spring in an unloaded condition.

FIGS. 3C and 3D illustrate portions of other embodiments of strings 26*d*, 26*e*, respectively, which may be incorporated into any of the products shown or described herein. The strings 26*d*, 26*e* each comprise the same seams and outer pockets 34 as incorporated into strings 26 shown in FIGS. 2 and 3. However, the springs 36*d*, 36*e* within the strings 26*d*, 26*e*, respectively are different than the springs 36 of strings 26. Although springs 36*d*, 36*e* are only shown in FIGS. 3C and 3D, they may be used in any string shown or described herein, including two-sided strings having cushion pads and buckling members above and below each inner pocketed coil spring regardless of the coil spring.

As shown in FIG. 3C, coil springs 36*d* (only one being shown) each have identical end turns 38*d* of a smaller diameter than the central convolutions 42*d* therebetween in a central portion 44*d* thereof. The central convolutions 42*d* of coil springs 36*d* are identical having the same diameter which is greater than the diameter of end turns 38*d*.

As shown in FIG. 3D, coil springs 36*e* (only one being shown) each have two identical end portions 46*e* and a central portion 44*e* therebetween. The central portion 44*e* has more convolutions than each end portion 46*e*, as shown in FIG. 3D. Each coil spring 36*e* has identical end turns 38*e* of a larger diameter than the central convolutions 42*e* therebetween of the central portion 44*e*. The central convolutions 42*e* of coil springs 36*e* have a smaller diameter than the diameter of end turns 38*e*.

Figure 10:
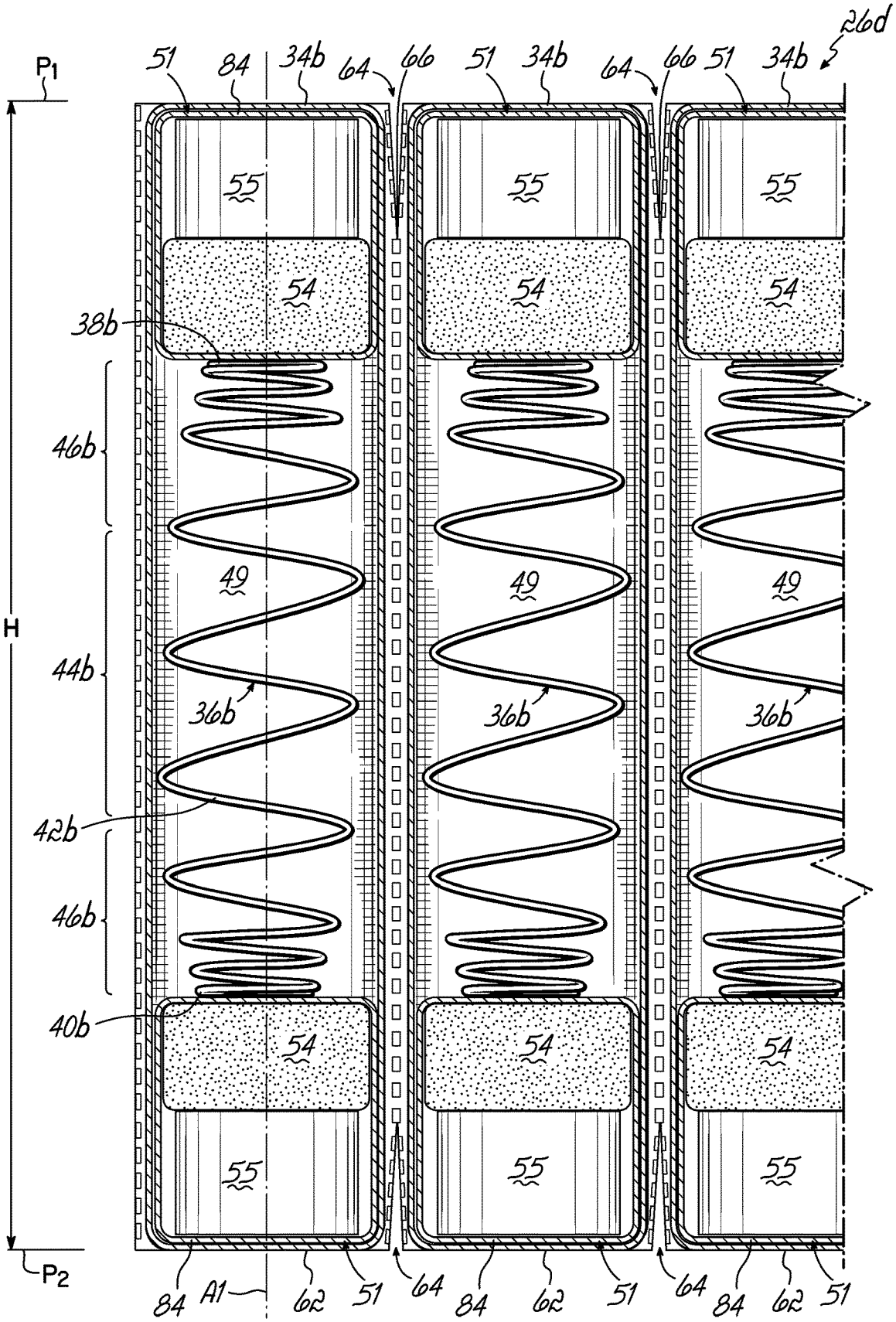
FIG. 10 is a cross-sectional view, partially broken away, of another string of springs in an unloaded condition.

FIG. 10 illustrates another embodiment of string 26*d* which may be used in any of the pocketed spring assemblies or products shown or described herein. The double-sided string 26*d* comprises the same seams, same coil springs 36*b* and outer fabric pockets 34*b* as incorporated into strings 26*b* shown in FIG. 7. However, each coil spring 36 lacks an inner pocket but has two individually pocketed combination pads 51.

Like the combination pads 51 shown in FIG. 6, each of the outer fabric pockets 34*b* includes a combination pad 51 above the coil spring 36*b*. However, in double-sided string 26*d*, a second combination pad 51 is located below the coil spring 36*b*. Each combination pad 51 comprises a cushion pad 54 and a buckling member 55 which in combination are encased in a fabric cover 84. Each combination pad 51 has its own fabric cover 84 which prevents un-pocketed coil spring 36*b* from contacting and damaging the cushion pad or pads over time.

Although string 26*d* is shown as a double-sided string, the concept illustrated therein of combining an un-pocketed coil spring with pocketed combination pads may be incorporated into any of the strings or pocketed spring assemblies shown or described herein, including single sided strings and single-sided pocketed spring assemblies. Any of the coil springs shown or described herein may be used in a version in which the cushion pad or pads/buckling member or buckling members is pocketed and the coil spring has no inner pocket, just an outer pocket.

Figure 11:
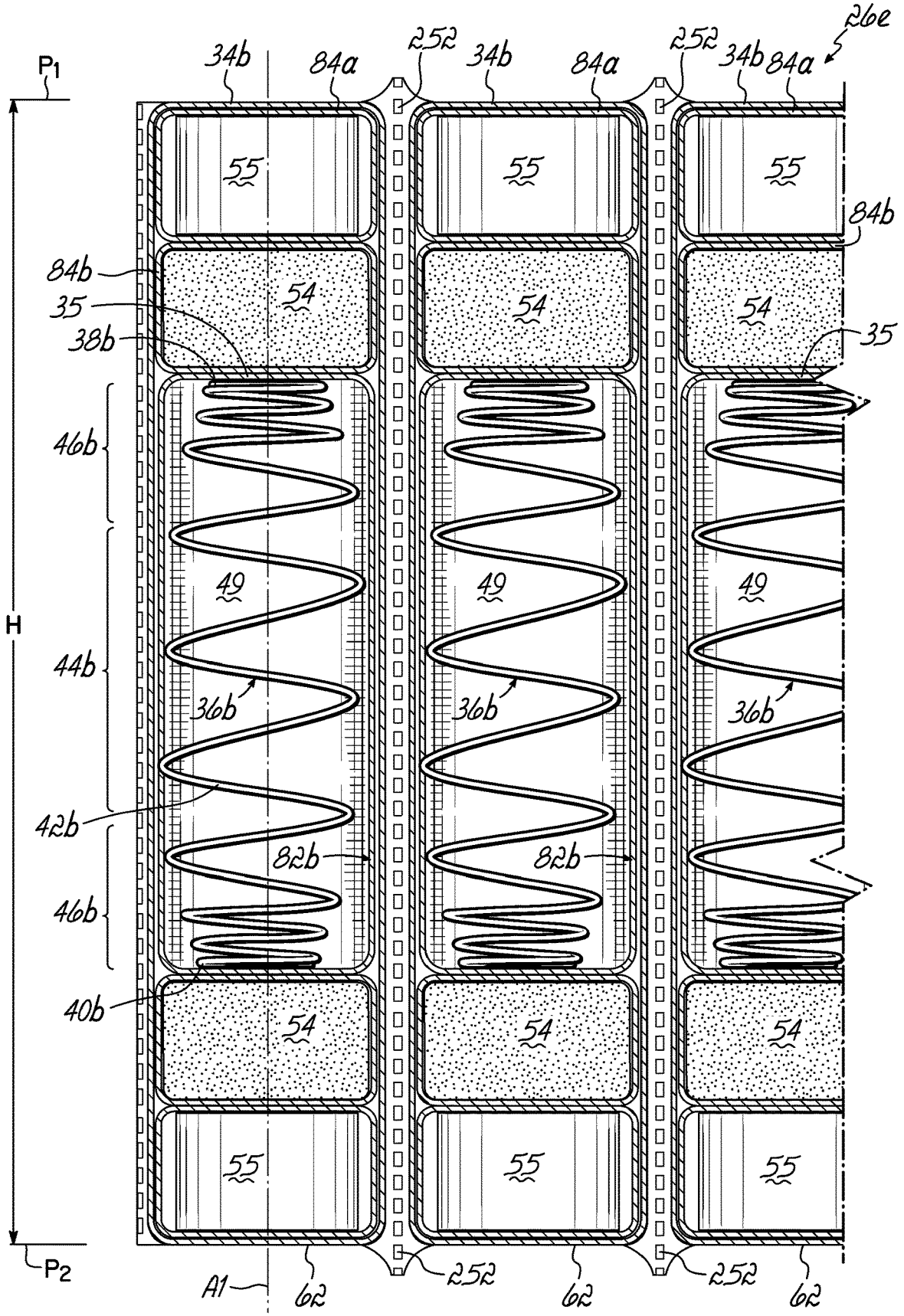
FIG. 11 is a cross-sectional view, partially broken away, of another string of springs in an unloaded condition.

FIG. 11 illustrates another embodiment of string 26*e* which may be used in any of the pocketed spring assemblies or products shown or described herein. The double-sided string 26*e* comprises transverse seams 252, same inner pocketed springs 82*b* including same coil springs 36*b* as shown in FIG. 7, cushion pads 54 and cushion members 55. Each cushion pad 54 is encased in a fabric cover 84*b* and each buckling member 55 is encased in a fabric cover 84*a*. Thus, each cushion pad 54 has its own fabric cover 84*b* which prevents the coil spring 36 of the inner pocketed coil spring 82 from contacting and damaging the cushion pad or pads over time, in addition to the inner pocket 35 of fabric of the inner pocketed coil spring 82.

However, each string 26*e* lacks divides 64 or "split top" feature. Any of the embodiments of strings or pocketed spring assemblies shown or described herein may lack the divides or "split top" feature regardless of the whether one-sided or double-sided.

FIGS. 12A-12H illustrate top views of different buckling members which may be substituted for the buckling members 55 shown and described herein. Although each of the buckling members shown in FIGS. 12A-12H are illustrated being un-pocketed any of them may be individually pocketed.

Figure 12A:
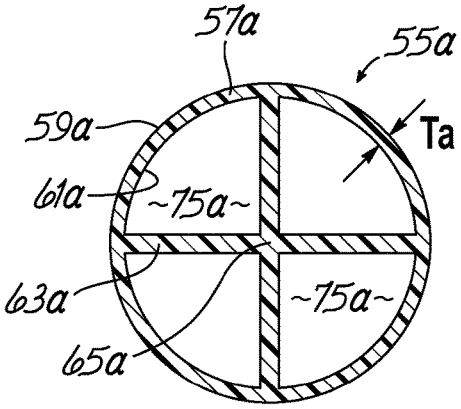
FIG. 12A is a top view of an alternative buckling member.

FIG. 12A illustrates a cross-sectional view of another cylindrical shaped buckling member 55*a* which may be used in any embodiment of string shown or described herein. Buckling member 55*a* is illustrated having a circular outer wall 57*a* having an outer surface 59*a* and an inner surface 61*a*, the distance between which defines the thickness "Ta" of the circular outer wall 57*a*. The buckling member 55*a* has four internal ribs 63*a* which extend from the outer wall 57*a* to a center 65*a*. The buckling member 55*a* may be any desired height. The buckling member 55*a* has an open top and open bottom defining four internal passages 75*a* between the internal ribs 63*a* and outer wall 57*a*. Although the drawings illustrate one thickness "Ta" of outer wall 57*a*, the outer wall 57*a* may be any desired thickness. Although the drawings illustrate the internal ribs 63*a* having one thickness, the internal ribs may be any desired thickness.

Figure 12B:
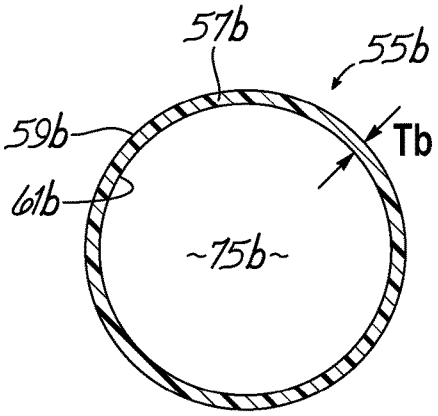
FIG. 12B is a top view of an alternative buckling member.

FIG. 12B illustrates a cross-sectional view of another cylindrical shaped buckling member 55*b* which may be used in any embodiment of string shown or described herein. Buckling member 55*b* is illustrated having a circular outer wall 57*b* having an outer surface 59*b* and an inner surface 61*b*, the distance between which defines the thickness "Tb" of the circular outer wall 57*b*. The buckling member 55*a* has no internal ribs and may be any desired height. The buckling member 55*b* has an open top and open bottom defining one internal passage 75*b* inside outer wall 57*b*. Although the drawings illustrate one thickness "Tb" of outer wall 57*b*, the outer wall 57*b* may be any desired thickness.

Figure 12C:
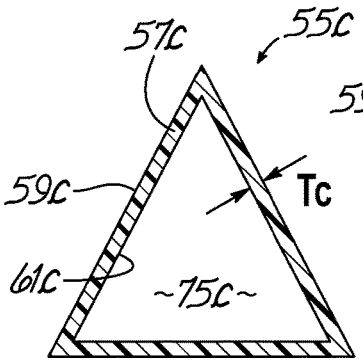
FIG. 12C is a top view of an alternative buckling member.

FIG. 12C illustrates a cross-sectional view of another buckling member 55*c* which may be used in any embodiment of string shown or described herein. Buckling member 55*c* is illustrated having a triangular shaped outer wall 57*c* having an outer surface 59*c* and an inner surface 61*c*, the distance between which defines the thickness "Tc" of the triangular outer wall 57*c*. The buckling member 55*c* may be any desired height. The buckling member 55*c* has an open top and open bottom defining one internal passage 75*c* inside outer wall 57*c*. Although the drawings illustrate one thickness "Tc" of outer wall 57*c*, the outer wall 57*c* may be any desired thickness.

Figure 12D:
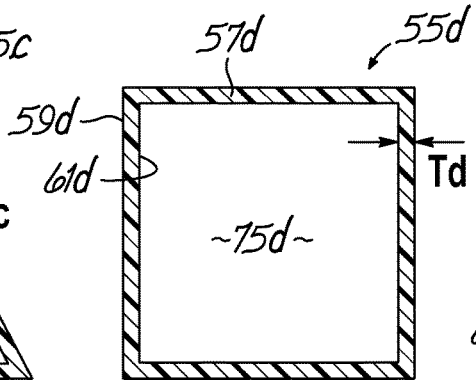
FIG. 12D is a top view of an alternative buckling member.

FIG. 12D illustrates a cross-sectional view of another buckling member 55*d* which may be used in any embodiment of string shown or described herein. Buckling member 55*d* is illustrated having a square shaped outer wall 57*d* having an outer surface 59*d* and an inner surface 61*d*, the distance between which defines the thickness "Td" of the square outer wall 57*d*. The buckling member 55*d* may be any desired height. The buckling member 55*d* has an open top and open bottom defining one internal passage 75*d* inside outer wall 57*d*. Although the drawings illustrate one thickness "Td" of outer wall 57*d*, the outer wall 57*d* may be any desired thickness.

Figure 12E:
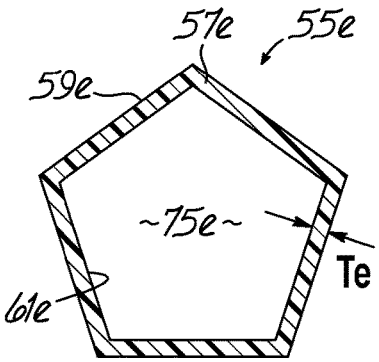
FIG. 12E is a top view of an alternative buckling member.

FIG. 12E illustrates a cross-sectional view of another buckling member 55*e* which may be used in any embodiment of string shown or described herein. Buckling member 55*e* is illustrated having a pentagon shaped outer wall 57*e* having an outer surface 59*e* and an inner surface 61*e*, the distance between which defines the thickness "Te" of the pentagon outer wall 57*e*. The buckling member 55*e* may be any desired height. The buckling member 55*e* has an open top and open bottom defining one internal passage 75*e* inside outer wall 57*e*. Although the drawings illustrate one thickness "Te" of outer wall 57*e*, the outer wall 57*e* may be any desired thickness.

Figure 12F:
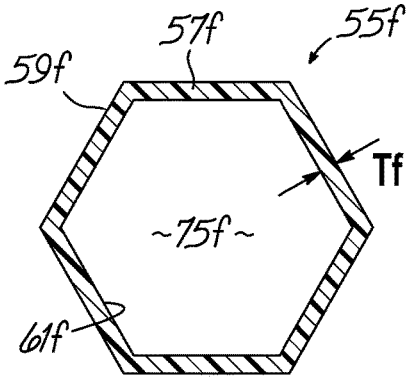
FIG. 12F is a top view of an alternative buckling member.

FIG. 12F illustrates a cross-sectional view of another buckling member 55*f* which may be used in any embodiment of string shown or described herein. Buckling member 55*f* is illustrated having a hexagon shaped outer wall 57*f* having an outer surface 59*f* and an inner surface 61*f*, the distance between which defines the thickness "Tf" of the hexagon outer wall 57*f*. The buckling member 55*f* may be any desired height. The buckling member 55*f* has an open top and open bottom defining one internal passage 75*f* inside outer wall 57*f*. Although the drawings illustrate one thickness "Tf" of outer wall 57*f*, the outer wall 57*f* may be any desired thickness.

Figure 12G:
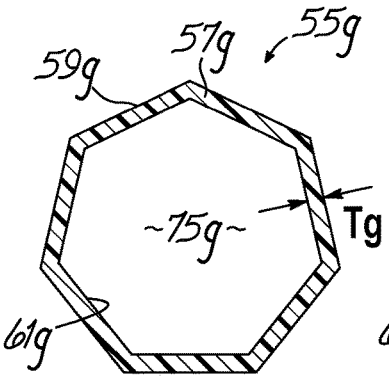
FIG. 12G is a top view of an alternative buckling member.

FIG. 12G illustrates a cross-sectional view of another buckling member 55*g* which may be used in any embodiment of string shown or described herein. Buckling member 55*g* is illustrated having a heptagon shaped outer wall 57*g* having an outer surface 59*g* and an inner surface 61*g*, the distance between which defines the thickness "Tg" of the pentagon outer wall 57*g*. The buckling member 55*g* may be any desired height. The buckling member 55*g* has an open top and open bottom defining one internal passage 75*g* inside outer wall 57*g*. Although the drawings illustrate one thickness "Tg" of outer wall 57*g*, the outer wall 57*g* may be any desired thickness.

Figure 12H:
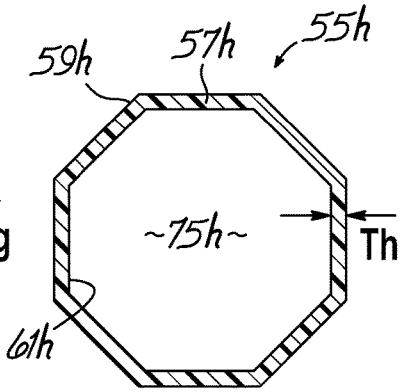
FIG. 12H is a top view of an alternative buckling member.

FIG. 12H illustrates a cross-sectional view of another buckling member 55*h* which may be used in any embodiment of string shown or described herein. Buckling member 55*h* is illustrated having an octagon shaped outer wall 57*h* having an outer surface 59*h* and an inner surface 61*h*, the distance between which defines the thickness "Th" of the pentagon outer wall 57*h*. The buckling member 55*h* may be any desired height. The buckling member 55*h* has an open top and open bottom defining one internal passage 75*h* inside outer wall 57*h*. Although the drawings illustrate one thickness "Th" of outer wall 57*h*, the outer wall 57*h* may be any desired thickness.

Figure 13:
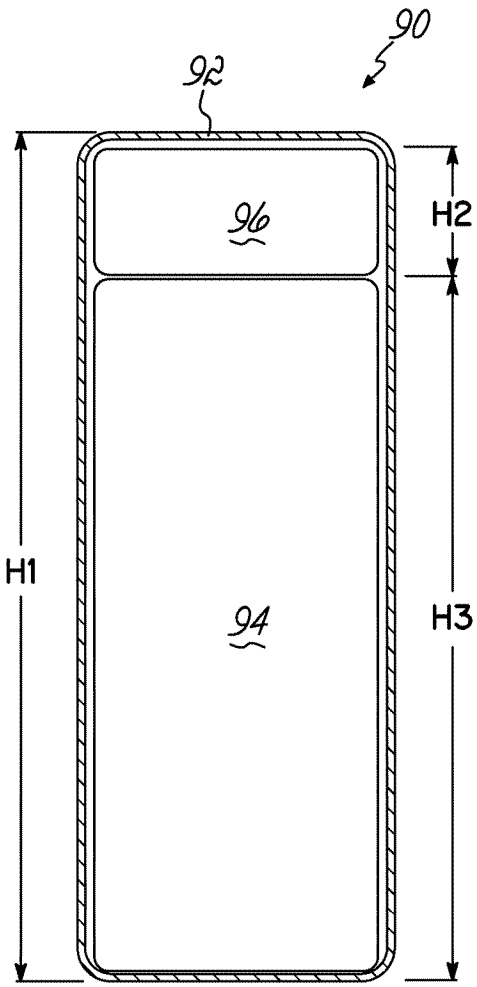
FIG. 13 is a schematic cross-sectional view of one string of springs in an unloaded condition.

FIG. 13 is a schematic illustration of a cross-section of a single-sided string 90 for use in a single-sided pocketed spring assembly. The single-sided string 90 comprises an outer pocket 92 having a height H1. A main member 94 having a height H3 is located inside the outer pocket 92 at the bottom thereof. A supplemental member 96 having a height H2 is located above the main member 94 inside the outer pocket 92. The sum of the heights H3, H2 of the main and supplemental members 94, 96, respectively, is approximately the same as the height H1 of the single-sided string 90. The drawings are not intended to limit the heights of the main and supplemental members 94, 96 to those illustrated. The main member 94 may be a pocketed spring, a non-pocketed spring, a pocketed or non-pocketed foam member or a pocketed or non-pocketed buckling member. The supplemental member 96 may be a pocketed spring, a non-pocketed spring, a pocketed or non-pocketed foam member or a pocketed or non-pocketed buckling member. Although FIG. 13 illustrates the main and supplemental members 94, 96, respectively, being cylindrical, either one of them may be any desired shape, including any of the shapes shown in FIG. 12A-12H.

Figure 14:
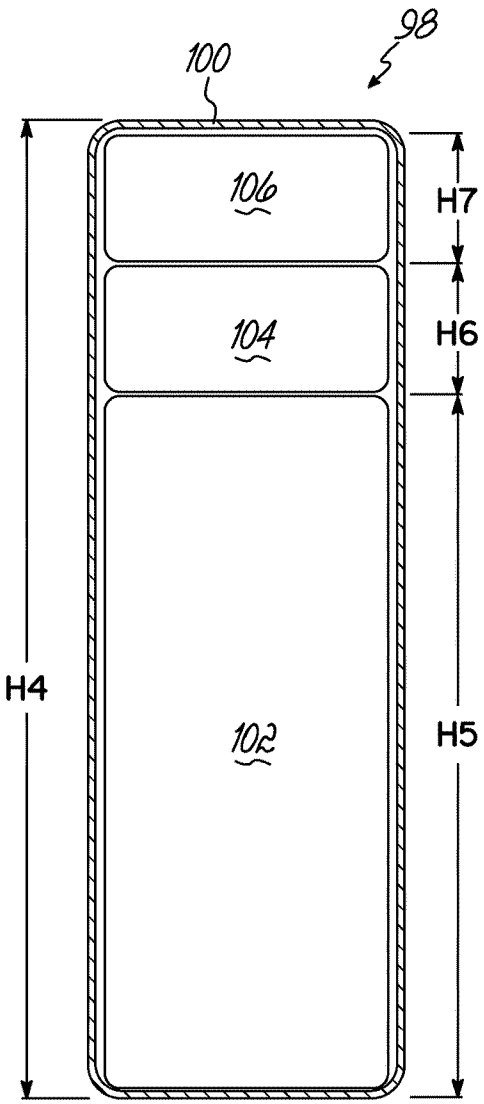
FIG. 14 is a schematic cross-sectional view of another string of springs in an unloaded condition.

FIG. 14 is a schematic illustration of a cross-section of a single-sided string 98 for use in a single-sided pocketed spring assembly. The single-sided string 98 comprises an outer pocket 100 having a height H4. A main member 102 having a height H5 is located inside the outer pocket 100 at the bottom thereof. A first supplemental member 104 having a height H6 is located above the main member 102 inside the outer pocket 100. A second supplemental member 106 having a height H7 is located above the first supplemental member 104 inside the outer pocket 100. The sum of the heights H5, H6 and H7 of the main and supplemental members 102, 104, 106, respectively, is approximately the same as the height H4 of the single-sided string 98. The drawings are not intended to limit the heights of the main and supplemental members 102, 104, 106 to those illustrated. The main member 102 may be a pocketed spring, a non-pocketed spring, a pocketed or non-pocketed foam member or a pocketed or non-pocketed buckling member. The first supplemental member 104 may be a pocketed spring, a non-pocketed spring, a pocketed or non-pocketed foam member or a pocketed or non-pocketed buckling member. The second supplemental member 106 may be a pocketed spring, a non-pocketed spring, a pocketed or non-pocketed foam member or a pocketed or non-pocketed buckling member. Although FIG. 14 illustrates the main and supplemental members 102, 104, 106, respectively, being cylindrical, either one of them may be any desired shape, including any of the shapes shown in FIG. 12A-12H.

Figure 15:
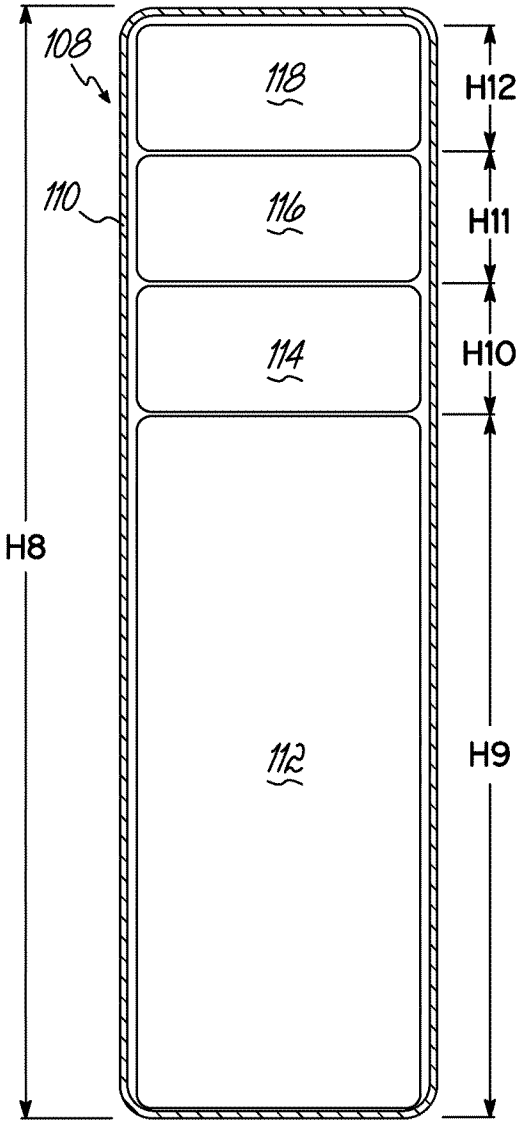
FIG. 15 is a schematic cross-sectional view of another string of springs in an unloaded condition.

FIG. 15 is a schematic illustration of a cross-section of a single-sided string 108 for use in a single-sided pocketed spring assembly. The single-sided string 108 comprises an outer pocket 110 having a height H8. A main member 112 having a height H9 is located inside the outer pocket 110 at the bottom thereof. A first supplemental member 114 having a height H10 is located above the main member 112 inside the outer pocket 110. A second or middle supplemental member 116 having a height H11 is located above the first supplemental member 114 inside the outer pocket 110. A third supplemental member 118 having a height H12 is located above the second or middle supplemental member 116 inside the outer pocket 110. The sum of the heights H9, H10, H11 and H12 of the main and supplemental members 112, 114, 116, 118 respectively, is approximately the same as the height H8 of the single-sided string 108. The drawings are not intended to limit the heights of the main and supplemental members 112, 114, 116, 118 to those illustrated. The main member 112 may be a pocketed spring, a non-pocketed spring, a pocketed or non-pocketed foam member or a pocketed or non-pocketed buckling member. The first supplemental member 114 may be a pocketed spring, a non-pocketed spring, a pocketed or non-pocketed foam member or a pocketed or non-pocketed buckling member. The second supplemental member 116 may be a pocketed spring, a non-pocketed spring, a pocketed or non-pocketed foam member or a pocketed or non-pocketed buckling member. The third supplemental member 118 may be a pocketed spring, a non-pocketed spring, a pocketed or non-pocketed foam member or a pocketed or non-pocketed buckling member. Although FIG. 15 illustrates the main and supplemental members 112, 114, 116, 118 respectively, being cylindrical, any one of them may be any desired shape, including any of the shapes shown in FIG. 12A-12H.

Figure 16:
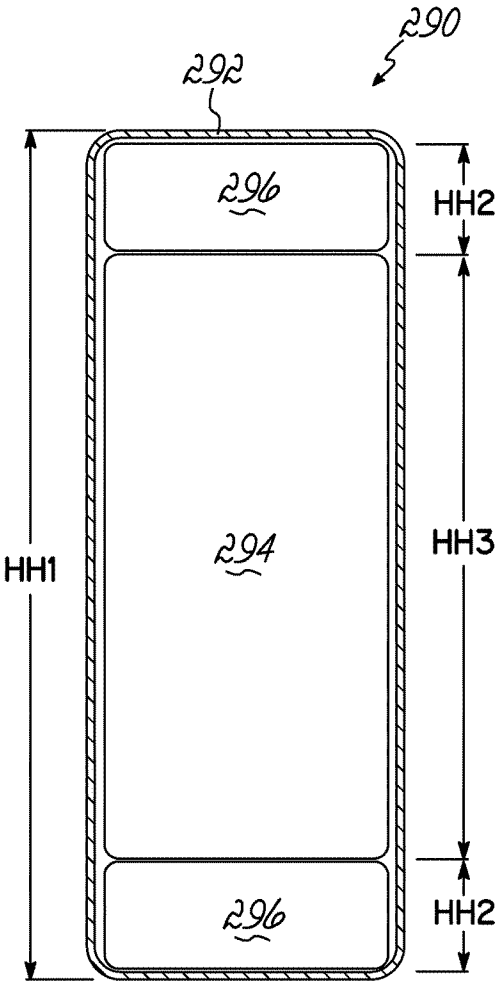
FIG. 16 is a schematic cross-sectional view of another string of springs in an unloaded condition.

FIG. 16 is a schematic illustration of a double-sided string 290 for use in a double-sided pocketed spring assembly. The double-sided string 290 comprises a main member 294 and two supplemental members 296 encased by an outer pocket 292. As shown in FIG. 16, the double-sided string 290 in a relaxed condition has a height HH1. The main member 294 has a height HH3 and is located inside the outer pocket 292 between the two supplemental members 296. Each supplemental member 296 inside the outer pocket 292 has a height HH2. The sum of the heights HH3, HH2 of the main and supplemental members 294, 296 is approximately the same as the height HH1 of the double-sided string 290 when the double-sided string 290 is in a relaxed condition as shown in FIG. 16. The drawings are not intended to limit the heights of the main and supplemental members 294, 296 to those illustrated. The main member 294 may be a pocketed spring, a non-pocketed spring, a pocketed or non-pocketed foam member or a pocketed or non-pocketed buckling member. Each supplemental member 296 may be a pocketed spring, a non-pocketed spring, a pocketed or non-pocketed foam member or a pocketed or non-pocketed buckling member. Although FIG. 16 illustrates the main and supplemental members 294, 296 being cylindrical, any of them may be any desired shape, including any of the shapes shown in FIG. 12A-12H.

Figure 17:
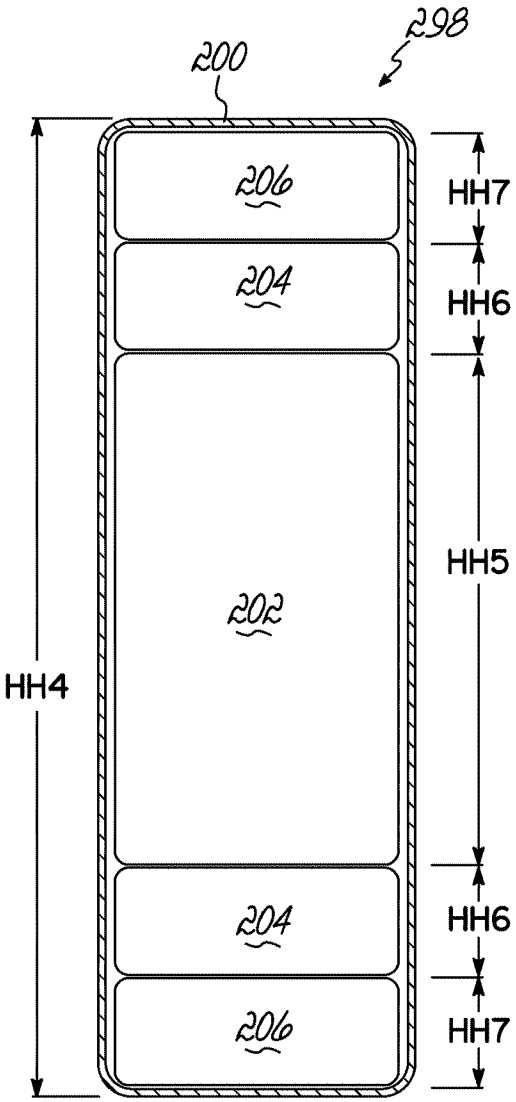
FIG. 17 is a schematic cross-sectional view of another string of springs in an unloaded condition.

FIG. 17 is a schematic illustration of a cross-section of a double-sided string 298 for use in a double-sided pocketed spring assembly. The double-sided string 298 comprises a main member 202, two inner supplemental members 204 and two outer supplemental members 206. The main member 202, two inner supplemental members 204 and two outer supplemental members 206 are encased by an outer pocket 200. As shown in FIG. 17, the double-sided string 298 in a relaxed condition has a height HH4. The main member 202 has a height HH5 and is located between the two inner supplemental members 204 inside the outer pocket 200. Each inner supplemental member 204 has a height HH6. An upper or first inner supplemental member 204 is located above the main member 202 inside the outer pocket 200. A lower or second inner supplemental member 204 is located below the main member 202 inside the outer pocket 200. An upper outer supplemental member 206 having a height HH7 is located above the upper inner supplemental member 204 inside the outer pocket 200. A second or lower outer supplemental member 206 having a height HH7 is located below the lower inner supplemental member 204 inside the outer pocket 200. The sum of the heights HH5, HH6 and HH7 of the main and supplemental members 202, 204, 206, respectively, is approximately the same as the height HH4 of the double-sided string 298 when the double-sided string 298 is in a relaxed condition. The drawings are not intended to limit the heights of the main and supplemental members 202, 204, 206 to those illustrated. The main member 202 may be a pocketed spring, a non-pocketed spring, a pocketed or non-pocketed foam member or a pocketed or non-pocketed buckling member. Each inner supplemental member 204 may be a pocketed spring, a non-pocketed spring, a pocketed or non-pocketed foam member or a pocketed or non-pocketed buckling member. Each outer supplemental member 206 may be a pocketed spring, a non-pocketed spring, a pocketed or non-pocketed foam member or a pocketed or non-pocketed buckling member. Although FIG. 17 illustrates the main and supplemental members 202, 204, 206, respectively, being cylindrical, either one of them may be any desired shape, including any of the shapes shown in FIG. 12A-12H.

Figure 18:
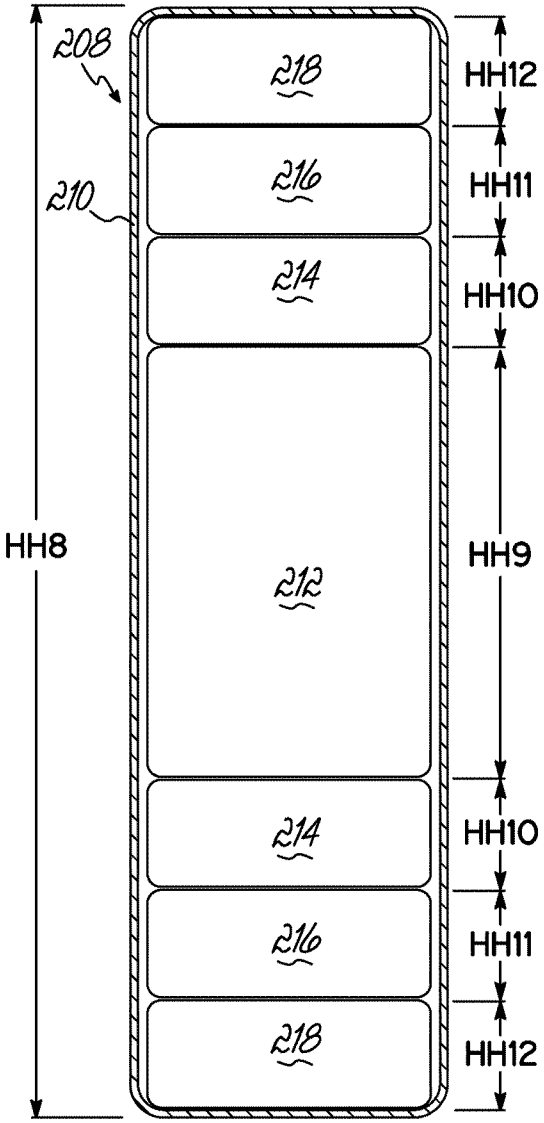
FIG. 18 is a schematic cross-sectional view of another string of springs in an unloaded condition.

FIG. 18 is a schematic illustration of a cross-section of a double-sided string 208 for use in a double-sided pocketed spring assembly. The double-sided string 208 comprises an outer pocket 210, two inner supplemental members 214, two middle supplemental members 216 and two outer supplemental members 218. The main member 212, two inner supplemental members 214, two middle supplemental members 216 and two outer supplemental members 218 are encased by an outer pocket 110. As shown in FIG. 18, the double-sided string 208 in a relaxed condition has a height HH8. The main member 212 has a height HH9 and is located between the two inner supplemental members 214 inside the outer pocket 210. Each inner supplemental member 214 has a height HH10. An upper or first inner supplemental member 214 is located above the main member 212 inside the outer pocket 208. A lower or second inner supplemental member 214 is located below the main member 212 inside the outer pocket 210. An upper middle supplemental member 216 having a height HH11 is located above the upper inner supplemental member 214 inside the outer pocket 210. A second or lower middle supplemental member 216 having a height HH11 is located below the lower inner supplemental member 214 inside the outer pocket 210. An upper outer supplemental member 218 having a height HH12 is located above the upper middle supplemental member 216 inside the outer pocket 210. A second or lower outer supplemental member 218 having a height HH12 is located below the middle supplemental member 216 inside the outer pocket 210. The sum of the heights HH9, HH10, HH11 and HH12 of the main and supplemental members 212, 214, 216, 218, respectively, is approximately the same as the height HH8 of the double-sided string 208 when the double-sided string 208 is in a relaxed condition. The drawings are not intended to limit the heights of the main and supplemental members 212, 214, 216, 218 to those illustrated. The main member 212 may be a pocketed spring, a non-pocketed spring, a pocketed or non-pocketed foam member or a pocketed or non-pocketed buckling member. Each inner supplemental member 214 may be a pocketed spring, a non-pocketed spring, a pocketed or non-pocketed foam member or a pocketed or non-pocketed buckling member. Each middle supplemental member 216 may be a pocketed spring, a non-pocketed spring, a pocketed or non-pocketed foam member or a pocketed or non-pocketed buckling member. Each outer supplemental member 218 may be a pocketed spring, a non-pocketed spring, a pocketed or non-pocketed foam member or a pocketed or non-pocketed buckling member. Although FIG. 18 illustrates the main and supplemental members 212, 214, 216, 218, respectively, being cylindrical, either one of them may be any desired shape, including any of the shapes shown in FIG. 12A-12H.

As shown in FIGS. 13-18, whether a string is single-sided or double-sided, without its fabric outer cover, any number of combinations of springs, foam and buckling members are possible. Any one or more of the springs, foam and buckling members may be encased in its own fabric cover. Any one or more of the springs, foam and buckling members may be any desired shape.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. For example, more than two cushion pads or more than one inner pocketed spring may be inside an outer pocket. The invention resides in each individual feature described herein, alone, and in all combinations of any and all of those features. Accordingly, the scope of the invention shall be limited only by the following claims and their equivalents.

What is claimed is:

1. A bedding or seating product comprising:

a pocketed spring assembly comprising a plurality of parallel strings of springs, each of said strings being joined to at least one adjacent string, each of said strings comprising a piece of fabric surrounding a plurality of inner pocketed springs, a plurality of cushion pads and a plurality of buckling members, first and second opposed plies of fabric being on opposite sides of the inner pocketed springs, cushion pads and buckling members, a plurality of outer pockets formed along said string by a longitudinal seam and transverse seams joining said first and second plies, at least one inner pocketed spring and at least one cushion pad and at least one buckling member being in each of said outer pockets, wherein each of the buckling members has an outer wall, internal ribs extending inwardly from the outer wall to a center, an open top and an open bottom defining passages between the internal ribs.

2. The product of claim 1, wherein each of the outer pockets includes a combination pad above the inner pocketed coil spring, the combination pad comprising one of the cushion pads and one of the buckling members which in combination are encased in a fabric cover.

3. The product of claim 1, wherein an upper end of each of said transverse seams is below an upper surface of the string to partially separate adjacent outer pockets.

4. The product of claim 1, wherein one of the cushion pads and one of the buckling members are pocketed together inside one of the outer pockets.

5. The product of claim 1, wherein two cushion pads and two buckling members are in each of the outer pockets.

6. The product of claim 1, wherein at least one cushion pad and at least one buckling member are above one of the inner pocketed springs inside each of the outer pockets.

7. A pocketed spring assembly for a bedding or seating product, said pocketed spring assembly comprising:

a plurality of parallel strings of springs, each of the strings being joined to at least one adjacent string, each of the strings comprising a plurality of interconnected outer pockets made from one piece of fabric, each of the outer pockets containing an inner pocketed spring and a combination pad, the combination pad comprising a cushion pad and a buckling member encased together in a fabric cover, the piece of fabric being joined to itself along a longitudinal seam and having first and second opposed plies of fabric on opposite sides of the springs, the first and second plies being joined by transverse seams between adjacent inner pocketed springs, wherein the buckling member has an outer wall, internal ribs extending inwardly from the outer wall to a center, an open top and an open bottom defining passages between the internal ribs.

8. The pocketed spring assembly of claim 7, wherein two cushion pads and two buckling members are in each of the outer pockets.

9. The pocketed spring assembly of claim 8, wherein said inner pocketed spring is between the cushion pads and between the buckling members in each of the outer pockets.

10. The pocketed spring assembly of claim 7, wherein each of said transverse seams forming adjacent outer pockets of said string has one end located below an upper surface of said string to partially separate adjacent outer pockets.

11. The pocketed spring assembly of claim 10, wherein the inner pocketed springs are below the upper end of adjacent transverse seams.

12. The pocketed spring assembly of claim 7, wherein each of said cushion pads is made at least partially of foam.

13. The pocketed spring assembly of claim 7, wherein the buckling member has four internal ribs.

14. A pocketed spring assembly for a bedding or seating product, said pocketed spring assembly comprising:

a plurality of parallel strings of springs, each of the strings being joined to an adjacent string, each of the strings comprising a plurality of interconnected outer pockets made from one piece of fabric, each of the outer pockets containing one inner pocketed spring, and a combination pad comprising at least one cushion pad and at least one buckling member, the piece of fabric being joined to itself along a longitudinal seam and having first and second opposed plies of fabric on opposite sides of the inner pocketed springs, the fabric of said first and second plies being joined by transverse seams, each of the transverse seams being shorter than the string, wherein each of the buckling members has an outer wall, internal ribs extending inwardly from the outer wall to a center, an open top and an open bottom defining passages between the internal ribs.

15. The pocketed spring assembly of claim 14, wherein each of the buckling members has four internal ribs.

16. The pocketed spring assembly of claim 14, wherein said buckling members are made of plastic.

17. The pocketed spring assembly of claim 14, wherein each of said buckling members is individually pocketed with at least one of the cushion pads.

18. The pocketed spring assembly of claim 14, wherein the cushion pads are made at least partially of foam.

19. The pocketed spring assembly of claim 14, wherein at least one of the buckling members has a hollow interior.

* * * * *